US010702036B2

(12) United States Patent
Weatherly et al.

(10) Patent No.: US 10,702,036 B2
(45) Date of Patent: Jul. 7, 2020

(54) HAIR STYLING APPARATUS

(71) Applicant: JEMELLA LIMITED, Leeds (GB)

(72) Inventors: Robert Alexander Weatherly, Cambridgeshire (GB); Daniel Brady, Berkshire (GB); Steve Sayers, Buckinghamshire (GB); Mark Andrew Gagiano, Western Australia (AU); Timothy David Moore, Hertfordshire (GB); Paul Scott, Cambridgeshire (GB); Jeremy Peter Clements, Cambridgeshire (GB); James Baker, Cambridgeshire (GB); Paul Edwin Lewis, Cambridgeshire (GB)

(73) Assignee: Jemella Limited, Leeds (GB)

( * ) Notice: Subject to any disclaimer, the term of this patent is extended or adjusted under 35 U.S.C. 154(b) by 655 days.

(21) Appl. No.: 15/035,700

(22) PCT Filed: Nov. 12, 2014

(86) PCT No.: PCT/GB2014/053349
§ 371 (c)(1),
(2) Date: May 10, 2016

(87) PCT Pub. No.: WO2015/071656
PCT Pub. Date: May 21, 2015

(65) Prior Publication Data

US 2016/0286928 A1 Oct. 6, 2016

(30) Foreign Application Priority Data

Nov. 12, 2013 (GB) ..... 1319940.1
Nov. 12, 2014 (GB) ..... 1414531.2

(51) Int. Cl.
*A45D 2/40* (2006.01)
*A45D 1/28* (2006.01)
(Continued)

(52) U.S. Cl.
CPC ..... *A45D 2/40* (2013.01); *A45D 1/04* (2013.01); *A45D 1/28* (2013.01); *A45D 2/001* (2013.01)

(58) Field of Classification Search
CPC ... A45D 2/40; A45D 1/04; A45D 1/28; A45D 2/001
See application file for complete search history.

(56) References Cited

U.S. PATENT DOCUMENTS 1,691,115 A 11/1928 Jacobs
1,731,522 A 10/1929 Signe
(Continued)

FOREIGN PATENT DOCUMENTS

CN 202750913 * 2/2013 ..... A45D 1/04
CN 202750913 U 2/2013
(Continued)

OTHER PUBLICATIONS

Machine translation of WO 2005067760 retrieved from https://patentscope.wipo.int/search/en/detail.jsf?docId=WO2005067760&tab=PCTDESCRIPTION&maxRec=1000 (Year: 2005).*
(Continued)

*Primary Examiner* — Heidi M Eide
(74) *Attorney, Agent, or Firm* — Schwegman Lundberg & Woessner, P.A.

(57) ABSTRACT

A hair styling apparatus having a pair of closable jaws to engage a user's hair. The jaws have complementary shapes with a first said jaw defining a curved ridge and a second said jaw defining a curved recess. One or both of the jaws includes a heater such that, when said jaws are closed, hair is heated in a heating region between the ridge of the first jaw and the recess of said second jaw. The second jaw has a curved longitudinal surface having an active cooling
(Continued)

region. The heating region is located on the forward curve and the active cooling region is located on the reverse curve.

20 Claims, 16 Drawing Sheets

(51) Int. Cl.
*A45D 1/04* (2006.01)
*A45D 2/00* (2006.01)

(56) References Cited

U.S. PATENT DOCUMENTS

| | | | | |
|---|---|---|---|---|
| 4,819,674 | A | 4/1989 | Takimae | |
| 4,917,078 | A | 4/1990 | Zaborowski | |
| 5,120,933 | A | 6/1992 | Altamore et al. | |
| 5,357,988 | A | 10/1994 | Nakamura | |
| 5,799,671 | A | 9/1998 | Takimae | |
| 6,070,596 | A * | 6/2000 | Altamore | A45D 1/04 132/224 |
| 6,278,086 | B1 * | 8/2001 | Janouch | A45D 1/04 132/231 |
| RE38,713 | E | 3/2005 | Habibi | |
| 7,445,012 | B2 * | 11/2008 | Mukai | A45D 1/04 132/224 |
| D606,251 | S | 12/2009 | Leung | |
| D606,252 | S | 12/2009 | Leung | |
| 8,013,274 | B2 | 9/2011 | Suzuki et al. | |
| 9,173,465 | B2 | 11/2015 | Morgandi | |
| 9,788,624 | B2 | 10/2017 | Weatherly et al. | |
| 2006/0037625 | A1 | 2/2006 | Kayser et al. | |
| 2006/0201527 | A1 | 9/2006 | Higgins et al. | |
| 2006/0207625 | A1 | 9/2006 | Chan | |
| 2008/0257372 | A1 | 10/2008 | Mills et al. | |
| 2009/0260650 | A1 | 10/2009 | Jung | |
| 2010/0086577 | A1 | 4/2010 | Munoz et al. | |
| 2010/0101599 | A1 | 4/2010 | Choi | |
| 2010/0132733 | A1 | 6/2010 | Kyu et al. | |
| 2010/0154817 | A1 | 6/2010 | Lee | |
| 2011/0056509 | A1 * | 3/2011 | Benest | A45D 1/04 132/223 |
| 2011/0108052 | A1 | 5/2011 | Morgandi et al. | |
| 2011/0232673 | A1 | 9/2011 | Crawford | |
| 2011/0253164 | A1 | 10/2011 | Morgandi et al. | |
| 2012/0111354 | A1 | 5/2012 | Cafari et al. | |
| 2012/0312320 | A1 * | 12/2012 | Humphreys | A45D 1/04 132/211 |
| 2014/0238432 | A1 | 8/2014 | Deng | |
| 2015/0122284 | A1 | 5/2015 | Smith | |
| 2016/0213117 | A1 * | 7/2016 | Keong | A45D 1/04 |

FOREIGN PATENT DOCUMENTS

| | | | | |
|---|---|---|---|---|
| DE | 3115569 | A1 | 12/1982 | |
| DE | 3215232 | A1 | 10/1983 | |
| DE | 19748067 | | 5/1999 | |
| DE | 102010061907 | | 5/2012 | |
| DE | 102010062715 | * | 6/2012 | A45D 1/06 |
| EP | 0448778 | A2 | 10/1991 | |
| EP | 2745728 | A1 | 6/2014 | |
| EP | 2802234 | A2 | 11/2014 | |
| GB | 2016051 | A | 9/1979 | |
| GB | 2163574 | A | 2/1986 | |
| GB | 2312840 | A | 11/1997 | |
| GB | 2318544 | A | 4/1998 | |
| GB | 2459507 | | 10/2009 | |
| GB | 2477834 | A | 4/2011 | |
| GB | 2498417 | A | 7/2013 | |
| JP | 2004230180 | A | 8/2004 | |
| JP | 2005-519662 | A | 7/2005 | |
| JP | 2008-119471 | A | 5/2008 | |
| JP | 2009-501558 | A | 1/2009 | |
| JP | 2011104360 | A | 6/2011 | |
| KR | 1020090119155 | A | 11/2009 | |
| KR | 100953446 | B1 | 4/2010 | |
| KR | 100959792 | B1 | 5/2010 | |
| KR | 202010005327 | U | 5/2010 | |
| KR | 20120019693 | A | 3/2012 | |
| KR | 1020120019693 | A | 3/2012 | |
| WO | WO-03/075706 | A1 | 9/2003 | |
| WO | 2005067760 | A1 | 7/2005 | |
| WO | 2006099522 | | 9/2006 | |
| WO | 2007000700 | A2 | 1/2007 | |
| WO | 2008032978 | | 3/2008 | |
| WO | 2008032978 | A1 | 3/2008 | |
| WO | 2008062293 | A1 | 5/2008 | |
| WO | 2009074788 | A2 | 6/2009 | |
| WO | 2013013965 | | 1/2013 | |
| WO | 2013104903 | A2 | 7/2013 | |

OTHER PUBLICATIONS

Machine translation for CN 202750913 retreived from EPO on Jul. 14, 2019.*

Machine translation from DE 102010062715 retreived from EPO on Jul. 14, 2019.*

"British Application Serial No. 1720073.4, Combined Search and Examination Report dated Jan. 30, 2018", 7 pgs.

"International Application Serial No. PCT/GB2014/053349, International Preliminary Report on Patentability dated May 26, 2016", 10 pgs.

"International Application Serial No. PCT/GB2014/053349, Written Opinion dated Feb. 26, 2015", 8 pgs.

"Japanese Application Serial No. 2014-551672, Amendment filed Dec. 7, 2017 in response to Decision dated Aug. 7, 2017", (w/ English Translation), 7 pgs.

"Japanese Application Serial No. 2014-551672, Decision dated Aug. 7, 2017", (w/ English Translation), 14 pgs.

"Japanese Application Serial No. 2014-551672, Report of Reconsideration dated Jan. 4, 2018", (w/ English Translation), 6 pgs.

"Japanese Application Serial No. 2014-551672, Written Argument and Amendment filed Jun. 5, 2017 in response to Office Action dated Dec. 5, 2016", (w/ English Translation), 16 pgs.

CN Office Action dated Dec. 5, 2016 re: Application No. 2014-551672; pp. 1-5; citing: JP 2004-230180, JP 2008-119471, JP 2011-104360, U.S. Pat. No. 1,731,522, US 2011/0056509.

Japanese office action for corresponding application 2014-551672; Report dated Dec. 5, 2016.

Russian Office Action for corresponding application 2014132880/12(052935) filed Jan. 10, 2013; Report dated Feb. 1, 2017.

British Examination Report for corresponding application GB1214875.5; dated Feb. 7, 2013.

British Search Report for corresponding application GB1200337.2; dated May 10, 2012.

British Search Report for corresponding application GB1214875.5; dated Nov. 5, 2012.

British Search Report for corresponding application GB1311595.1; Report dated Dec. 12, 2013.

British Search Report for corresponding application GB1319940. 1; Report dated Nov. 7, 2014.

British Search Report for corresponding application GB1319940.1; Report dated May 9, 2014.

Final Office Action for corresponding application U.S. Appl. No. 14/370,408; dated May 10, 2016.

International Preliminary Report on Patentability for corresponding application PCT/GB2013/050036 filed Jan. 10, 2013; Report Jul. 15, 2014.

International Seach Report for corresponding application PCT/GB2014/053349 filed Nov. 12, 2014; dated Feb. 26, 2015.

International Search Report for corresponding application PCT/GB2013/050036 filed Jan. 10, 2013; dated Aug. 8, 2013.

New Zealand Examination Report for con-esponding application 628020; Report dated Nov. 25, 2014.

Non-Final Office Action corresponding application U.S. Appl. No. 14/370,408; dated Jul. 14, 2015.

Written Opinion for corresponding application PCT/GB2013/050036 filed Jan. 10, 2013; dated Aug. 8, 2013.

(56) References Cited

OTHER PUBLICATIONS

British Search Report for corresponding application GB1319940. 1; Report dated Nov. 11, 2014.
"Canadian Application Serial No. 2,876,118, Office Action dated Nov. 27, 2018", 3 pgs.
"Indian Application No. 3030/DELNP/2014 Office Action dated May 20, 2019", w/English Translation, 8 pgs.

* cited by examiner

HAIR STYLING APPARATUS

FIELD OF THE INVENTION

The invention relates to hair styling apparatus, particularly those for curling hair.

BACKGROUND TO THE INVENTION

There are a variety of hair styling apparatus for curling and straightening hair. One such apparatus for curling hair is known as an air brush or air styler. Such a styler generates a heated airflow which is delivered into the hair to create style (and/or volume). In some stylers, the heated airflow is delivered under pressure. Typically air brushes do not create a style quickly and easily. This is because the air temperature is too low (only 110° C.) to create style quickly. Furthermore, heat is not effectively delivered into the hair. Even for the products where the airflow is pressurised, the air pressure is too low to push the air through the hair and hence deliver the heat into the hair. The result is that the airflow tends to find an "easier" route which is not through the hair. The performance could be improved by increasing the pressure and temperature, e.g. by delivering the airflow though small holes.

Another apparatus for curling is known as a wand or tong. This comprises a heated generally cylindrical barrel. A hair section is wrapped around the barrel and the apparatus delivers heat from the surface of the barrel through the hair section. However, the heat transfer takes time and is very inefficient way of transferring the heat to the hair (hair is a thermal insulator). It is known to improve the thermal response by using ceramic heaters in the barrel. However, this does not address the inefficient method of transferring heat to the hair.

Ceramic heaters are also used in hair straightening devices. The inefficient method of transferring heat to the hair is addressed in such devices by providing two heating plates and placing the hair between the plates. This is a very efficient way of transferring the heat into the hair and provides a fast thermal response. Moreover, such stylers typically deliver longevity of style because of the effectiveness of transferring heat into and through the whole section of the hair. It is possible to use such hair straightening devices to curl hair by turning the hair straightener through 180°. However, this action is counter intuitive for most home users and particularly challenging in a mirror.

WO2008/062293 describes a hair straightener comprising a pair of flat heated hair styling surfaces and a cooling arrangement adjacent the styling surfaces to remove heat from the just-styled hair. Similarly, WO2007/000700 describes a straightener having a heating member and a cooling member. In both cases, the hair is cooled by after exiting from the heating member to prevent damage to the hair and to provide a longer lasting style.

Other examples and techniques can be found in DE102010062715, KR100953446, DE102010061907, KR100959792, DE19748067, GB2459507, US2010/0154817 and WO2008/062293.

WO2013/104903, WO2005/066760 and JP2004/230180 describe hair styling apparatus for curling hair.

The applicant has recognised the need for an improved apparatus which offers a quick and easy way to curl hair and also produces long lasting curls.

SUMMARY OF THE INVENTION

According to a first aspect of the invention, there is provided a combined hair curler and hair straightener (or hair styling apparatus for curling or straightening hair), comprising a pair of closable jaws to engage a user's hair;

- wherein said jaws have complementary shapes, a first said jaw defining a curved ridge and a second said jaw defining a curved recess; and
- wherein one or both of said jaws includes a heater such that, when said jaws are closed, hair is heated in a heating region between the ridge of said first jaw and the recess of said second jaw;
- wherein said second jaw has a curved longitudinal surface having an active cooling region;
- wherein a transverse cross section through said second jaw defines at least one S-shaped curve having a forward curve into which said ridge of said first jaw fits, and a linked reverse curve bearing said active cooling region on which hair may be cooled and curved;
- wherein said heating region is located on said forward curve; and
- wherein said active cooling region is located on said reverse curve such that, when said jaws are engaged, a tangent to a surface of engagement of the two jaws, at a point on said forward curve up to or at a point linking said forward and reverse curves avoids said active cooling region.

The apparatus may be used for both curling and straightening and may therefore be termed a combined hair curler and hair straightener. In the curling orientation, hair may rest on the cooling region under the tensional forces generated in the hair between the device and the users head and thus the cooling region may be facing upwards (or downwards) as long as the hair passes over the cooling region). It is also important to impart stress on the hair when in the curling orientation to maximise curling. The stress needs to be applied just as the hair exits the heating region. For example this may be achieved because in the curling orientation, the heating region may be generally perpendicular to the generally linear direction of movement and thus the hair is bent or stressed as it exits the heating region. Thus, the heating region is generally planar whereas the cooling region is generally curved.

The sides of the recess form part of the forward curve. Accordingly, it will be appreciated that the term "S-shaped" also includes an S having a part which may be generally straight. As explained in more detail below, a planar heating zone on the sides of the recess ensures good contact between the hair and the heating zone. When the arms are in the closed position, a tangent to a contacting surface (which may also be termed a surface of engagement) which is taken at any point on the forward curve (i.e. particularly at points on the sides) up to or at a point linking said forward and reverse curves avoids said cooling zone. This structure allows the user to rotate the apparatus between the curling and straightening orientations and keep the hair on the cooling zone in the curling orientation but away from the cooling zone in the straightening orientation.

The curved cooling region is along the edge of the recess and thus it is possible to prevent hair contacting the cooling region when a user wishes to straighten the hair. For example, this may be achieved in the straightening orientation because the heating region may be generally parallel to the generally linear direction of movement. Hair exiting the heating region is held under tension away from the cooling region. Thus, the cooling region may be facing towards a user's head to prevent hair contacting the region after heating. The dual functionality of the apparatus is important.

Thus according to another aspect of the invention, there is provided a hair styling apparatus for curling or straightening hair comprising a first and a second arm moveable between a closed position in which a contacting surface of the first arm is adjacent a contacting surface of the second arm and an open position in which the contacting surfaces of each arm are spaced apart, wherein the second arm comprises a channel having a base and sides; a heating zone on at least one side; and a curved cooling zone along an edge of the at least one side adjacent the heating zone;

wherein the first arm comprises a section which is received within the channel on the second arm, the section having a hair contacting surface and sides with a heating zone on at least one side;

wherein at least the sides of the channel and the sides of the section are the contacting surfaces of each arm and the heating zones on the first and second arms are adjacent when the arms are in the closed position;

wherein the apparatus has a curling orientation and a straightening orientation such that, in use, the hair styling apparatus is moved along a section of hair clamped between the two contacting surfaces in a generally linear direction and when the apparatus is in the curling orientation hair is curled on the curved cooling zone after being heated between the heating zones on the first and second arms and when the apparatus is in the straightening orientation hair has minimal contact with the curved cooling zone and is straightened.

It will be appreciated that the terms "arms" and "jaws" are interchangeable. Moreover, the arms/jaws are moveable relative to each other and thus one or both jaws/arms may move in use. Similarly, the terms "cooling zone" or "cooling region", "heating zone" or "heating region", "section" and "ridge" and "recess" or "channel" may be used interchangeably.

The first arm may comprise a flange extending along the at least one side of the section, wherein the flange is adjacent at least part of the cooling zone when the arms are in the closed position. The flange may assist in guiding the hair into the cooling zone. This flange may extend along a lateral (long) edge of the heating zone on the first arm. The flange preferably only extends across part of the cooling zone so that hair is not forced onto the cooling zone by the flange in the straightening orientation.

The sides of the section of the first arm and the sides of the channel may be generally parallel to each other and may be generally parallel to the direction of opening and closing the arms (i.e. generally perpendicular to the direction of motion along a user's hair). The sides may be at a draft angle of between 0 to 25 degrees (either positive or negative). A positive draft angle of 25 degrees allows easy opening and closing but provides poor clamping (stress imparted in the hair on the heater outlet) and hence poor curling. By contrast, a negative angle of 25 degrees provides excellent clamping at the heater outlet and additionally provides increased distance on the cooling surface for the hair to cool (i.e. as the hair passes from the heating zone to the cooling zone for curling) but is very difficult to open and close the product arms. Accordingly, a draft angle of 0 (i.e. parallel) is a good compromise.

The first arm and the second arm may both have a heating zone which ensures that the hair is heated from both sides which is more efficient for styling purposes. However, only one heating zone or region may be used. Where there are two zones, the first arm may comprise a first heating zone and a second heating zone, one on each side of the first arm. Similarly, the second arm may comprise a first heating zone and a second heating zone, one on each side of the second arm. The first heating zones on the first and second arms are adjacent when the arms are in the closed position. The second heating zones on the first and second arms are adjacent when the arms are in the closed position. Where there are two heating zones, there may be a first curved cooling zone adjacent the first heating zone on the second arm and a second curved cooling zone adjacent the second heating zone on the second arm. These features also apply equally to the first aspect of the invention. Thus, there may be a pair of said heating regions, one to either side of a point of said forward curve. Furthermore, said second jaw may define a pair of said S-shaped curves with a common said forward curve linked to first and second respective reverse curves, each of said reverse curves having a respective said active cooling region. Thus, the base and each side of the channel may form the common forward curve. In this way, the device may be used in both directions by a user or with either hand which simplifies its use.

The curved radius in the cooling zone preferably provides a bend in the hair tighter than its eventual desired curled form. This is to overcome the natural tendency for the hair to "recoil" towards a larger diameter after being bent around a small fixed radius on the heater outlet. The hair is then cooled as it recoils on the larger cool zone radius and enables curls to be generated quickly and efficiently. This is why is the stress (bend) is generated at the heater outlet, when the hair is hottest and the force required to bend the hair is lowest, resulting in more efficient curling effect (within the tight constraints of distance and time). The or each curved cooling zone may have a radius of curvature of approximately 7 mm adjacent the heating zone.

The heating and cooling zones are adjacent and may be spaced apart by a small gap or may abut. It is important to reduce heat transfer between the heating and cooling zone when possible. For example, in embodiments having a small gap, a thermal insulator may be placed between the heating and cooling zones. Alternatively, the heating zone and cooling zone may be coupled (or partially coupled) by a perforate connector. In embodiments, for example where the zones abut, each of the heating and cooling zones may have reduced thickness in the regions where they abut. A thermal insulator may also be positioned adjacent the portions having reduced thickness to further reduce heat transfer. The cooling and heating zones or regions may also be separated by a thermal zone to reduce heat transfer from any part of the heating zone or region to the adjacent cooling zone or region. There is no mention of such a thermal zone in some of the prior art documents such as WO2005/066760 and JP2004/230180. Without a thermal zone, the cooling zone or region would increase to too high a temperature, perhaps near to the lowest glass transition temperature of hair. If the cooling zone or region rises to such a "hot" temperature, the rate of use would need to be very slow to produce a curl. However, the hair would then be heated for a long length of time which could cause it to dry out before it reaches the cooling zone or region which makes it fundamentally impossible to curl the hair.

The or each curved cooling zone may have a cross-section which decreases in thickness towards the adjacent heating zone. This has the benefit of reducing heat transfer at the point adjacent where the heating and cooling zones touch. It also increases the thermal mass of the cooling zone and provides a greater cross-section for other cooling means, e.g.

a heat pipe as described below to be included in the cooling zone. The or each curved cooling zone may have a radius of curvature which increases from approximately 4 mm (possibly up to 7 mm) adjacent the heating zone to approximately 12 mm away from the heating zone. The curved cooling portion may have a radius of curvature of between 2 mm and 10 mm, in particular 6 or 7 mm. The radius of curvature of the curved cooling portion may vary between the edge adjacent the curved heating portion and the opposed edge. If the radius of curvature varies, there are preferably no step changes and so any transitional change is smooth. This arrangement may therefore reduce or even prevent frizz generation.

The heating zone preferably heats the hair to above the glass transition temperature, i.e. to at least 147° C. (this temperature will be dependent on the bound water within the hair, and can be adjusted with the addition of water by added deliberate means or as a result of ambient humidity). The heating zone may comprise active heating in the form of a heatable plate which is heated to heat the hair. The width of the heating zone is preferably sufficient to ensure that hair is heated to at least the lowest glass transition temperature Tg, but not excessively above this. The longer the hair is heated, the more the cooling required. Any excessive heating may reduce the resulting curl quality as hair exiting the cooling zone may be at a higher than optimal temperature to retain curls. Additionally the rate of heating hair is critical. It is necessary to raise the temperature of hair above Tg before the bound water defuses out of the hair fibres otherwise, Tg increases which reduces the efficiency of curling process (more heating, stress and cooling is then needed). So if the heated path length is too long, the bound water will defuse from the hair, raising the Tg, and reducing efficiency of the curling performance. There is no mention of the use of stress nor when to apply stress in some of the prior art documents such as WO2005/066760 and JP2004/230180.

The cooling zone preferably cools the hair to approximately 90° C. (however this will vary depend on rate of product use, the hair section size the user selects and the distance/time the hair passes around the cooling surface). In some embodiments, this may be achieved by regulating the temperature of the cooling zone to approximately 25° C. above ambient temperature. In use, the cooling zone will heat up as the heated hair transfers heat to the cooling zones. Accordingly, to maintain the desired temperature in the cooling zone, heat needs to be drawn away from the cooling zone to reduce the temperature in the cooling zone. Thus the cooling zone or cooling region is termed an active cooling zone/region. This is a fundamental difference over some of the prior art such as WO2005/066760 and JP2004/230180.

The cooling zone may comprise active cooling, e.g. one or more heat pipes through which fluid, e.g. air or water, may be pumped to cool the cooling zone. The heat pipe may comprise a thermally conductive material. Alternatively, a fan may be used to assist with cooling. The active cooling could also be generated or performance improved with high pressure air connecting through the hair itself at the cooling zone inlet. This may be used with or instead of conduction through a metal surface. Alternatively, the active cooling zone may comprise a heat sink, or one or more heat pipes connected to a heatsink to draw heat away from the cooling zone. The heat pipes and/or heat sink may be arranged along the length of the cooling members. Where there is a fan, the fan may be integrated within at least one heat sink which assists in providing a compact apparatus. The apparatus may further comprise an inlet, e.g. a mesh, through which air is drawn into the apparatus by the fan assembly. The inlet may be on an inner surface of at least one of the first and second arms to reduce the risk of debris entering the apparatus or the inlet being blocked by a user. There may be an outlet through which air is forced out of the apparatus by the fan assembly, the outlet may extend around an electrical connector through which the apparatus receives power.

There may be heat transfer means arranged to thermally link the two cooling zones. In this way, one of the cooling zones may be configured to heat the hair to a temperature of less 147° C., i.e. to preheat the hair. In use, when hair passes through a cooling zone after heating, heat is drawn out of the hair and absorbed in this cooling zone. The thermal link between the cooling zones may then introduce heat from this 'post-heated' hair cooling zone into the 'pre-heating' cooling zone. Hair is then 'preheated' before entering the heating zone to improve efficiency and allow for faster hair heating and styling. Used in reverse, the 'post heating' and 'pre-heated' cooling zones functions are swapped.

The heat transfer means may be a conductive plate, one or more conductive members or heat pipe for example. In some arrangements the heat transfer means may further comprise one or more cooling fins to further cool the cooling zones. Such cooling fins may project into a void between heatable plates in the cooling zone and the housing of the styling appliance. In such an arrangement air may then be blown through this void to further cooling the heat transfer means and/or cooling zones. The heat transfer means may extend laterally across the width of an arm or longitudinally along the length of an arm (e.g. as a heat pipe). The latter means that the heat transfer means is spaced away from the heating zones which improves the cooling.

The contacting surfaces of each arm or jaw may have a complementary profile or shape. This may be only in part for the heating zone or cooling zone. Preferably however this may be on both heating zones and possibly on the cooling zones. The contacting surfaces of each arm having complementary shapes ensures that the hair is in contact with both surfaces through both the heating and cooling zones. In other words, the contacting surfaces are generally parallel to each whether regardless of whether they are curved or planar. It is important to ensure that the two surfaces meet together uniformly to provide efficient heat transfer/cooling to the hair. The contacting surfaces may be supported on a resilient suspension in any of the arrangements described, e.g. elastomer supports, to allow some movement of each contacting surface relative to its arm, whereby an even finer tolerance is absorbed. This improves the good surface contact to the hair.

The heating zone and cooling zone may be integral, e.g. integrally formed. This allows the heating zone and cooling zone to be manufactured as a single component for each arm, thereby, reducing component count and assembly time. The integral heating and cooling component may be machined from metal, such as aluminium or copper for example. To minimise thermal transfer between the heating and cooling zones, the heating and cooling zone may be separated by a narrow connecting region, configured to minimise heat transfer. This connecting region may be, for example, a perforate strip and/or thin relative to the heating/cooling zones such that heat transfer is minimised.

The heating zone may be angled relative to the direction of opening and closing the arms. In such an embodiment hair may move through styling apparatus along a generally "S" shaped path from first cooling (preheating) zone to heating zone, then a reversed "S" shaped path from the heating zone and through the cooling zone. This arrangement allows for curling of the hair whilst enabling hair to enter and exit the apparatus in the same direction, without it being necessary to rotate the apparatus relative to the direction of movement in order to curl. In embodiments one arm may have a generally domed central section (forming all or part of the heating zone) which fits into a corresponding recess in the other arm. Accordingly the hair styling apparatus is arranged to provide curling of the hair without any rotation of the hair styling apparatus relative to the hair entering and exiting.

Each heating zone may comprise a plurality of heating zones to provide improved thermal control. By partitioning the heating zone up into a plurality of independently controllable smaller heating zones, each with their own heater element each heating zone heats a different longitudinal section of the heater. This arrangement of heating zones enables the temperature can be controlled dependent on the thickness, quality, condition and/or distribution of hair. Additionally or alternatively, the heating zone may be partitioned into independently controllable smaller heating zones across the width of the heater such that the temperature can be controlled along the path that hair is pulled through the apparatus. An example of a device incorporating such an arrangement can be found in GB2477834, herein incorporated by reference. The same arrangement may also be applied to the cooling zones.

The apparatus may comprise a biasing mechanism for biasing the first and second arms in the open position. The apparatus may also comprise at least one heat sink; and at least one heat pipe extending from the cooling zone to the at least one heat sink; wherein the biasing mechanism is thermally connected to the at least one heat sink. This provides a compact mechanism for cooling the cooling zone and may thus be used with or without the other features.

Thus according to another aspect of the invention, there is provided a hair styling apparatus comprising

- a first and a second arm moveable between a closed position in which a contacting surface of the first arm is adjacent a contacting surface of the second arm and an open position in which the contacting surfaces of each arm are spaced apart, whereby in use, a section of hair is clamped between the contacting surfaces when the arms are in the closed position;
- a heating zone on at least one of the contacting surfaces for heating the section of hair between the contacting surfaces;
- a cooling zone having a curved cooling portion adjacent the heating zone for cooling and curling the section of hair after the section of hair has been heated,
- a biasing mechanism for biasing the first and second arms in the open position;
- at least one heat sink; and
- at least one heat pipe extending from the cooling zone to the at least one heat sink
- wherein the biasing mechanism is thermally connected to the at least one heat sink.

The biasing mechanism may be in the form of a leaf spring which preferably has a spring force of between 1 to 10 Newton or between 1 to 5 Newton.

The hair styling apparatus may comprise at least one projection on the hair contacting surface of the section of the first arm, the at least one projection maintaining a minimum spacing between the contacting surfaces when the arms are in the closed position. This reduces frictional forces between the two adjacent heater plates causing damage to the plates surface with in turn reduces friction on the hair. Friction may further be reduced by providing a coating of a low friction material on all contacting surfaces. The projection may be used alone or in conjunction with other features.

Thus according to another aspect of the invention, there is provided a hair styling apparatus comprising

- a first and a second arm moveable between a closed position in which a contacting surface of the first arm is adjacent a contacting surface of the second arm and an open position in which the contacting surfaces of each arm are spaced apart, whereby in use, a section of hair is clamped between the contacting surfaces when the arms are in the closed position;
- a heating zone on at least one of the contacting surfaces for heating the section of hair between the contacting surfaces;
- a cooling zone having a curved cooling portion adjacent the heating zone for cooling and curling the section of hair after the section of hair has been heated,
- wherein at least one of the first and second arms comprises at least one projection which maintains a minimum spacing between the contacting surfaces when the arms are in the closed position.

The at least one projection may be adjacent the heating zone. There may be two projections, one at either end of the section to form a guide for guiding hair through the apparatus. The two projections may be at either end of the heating zone.

The performance of the hair styling apparatus may be improved by including at least one sensor providing sensor data and a processor which is configured to receive said sensor data and process said sensor data. For example, the processor may determine whether the hair styling apparatus is in an active state in which the hair styling apparatus is being used to style hair or in a passive state in which there is no styling; determine whether or not the hair styling apparatus has changed between the active and passive states and if the state has changed, control the heating system to change the temperature in the heating zone. Alternatively or additionally, where there are two heating and cooling zones on one arm, the processor may be configured to determine whether hair contacts the first heating and cooling zone before the second heating and cooling zone or vice versa. The processor may be configured to determine whether or not the temperature in the or each cooling region or zone is above a threshold temperature, say 80 degrees C. (or 85 degrees C.), and to power down the hair styling apparatus when the determined temperature is above the threshold temperature. The apparatus may be powered down by activating a cut-off. This acts as a safety mechanism to reduce the risk of a user being injured if the apparatus overheats.

For example, if the processor determines that the state has changed from the active state to the passive state, the processor may be configured to reduce the temperature in the heating zone, preferably to between 140 to 180 degrees C. Similarly, if the processor determines that the state has changed from the passive state to the active state, the processor may be configured to increase the temperature in the heating zone, preferably to approximately 185 degrees C. If the processor determines that the hair contacts the first heating and cooling zone before the second heating and cooling zone, the processor may be configured to adjust power to the first heating zone to be lower than power to the second heating zone.

The at least one sensor may measure the temperature in the or each heating zone, temperature in the or each cooling zone and/or power consumption. Where the temperature in the heating zone is measured, the processor may be configured to determine that the apparatus is in the active state when the temperature reduces between subsequent measurements. Similarly, when the temperature in the cooling zone is measured, the processor may be configured to determine that the apparatus is in the active state when the temperature rises between subsequent measurements. Alternatively or additionally, when power consumption within the heating zone is measured, the processor may be configured to determine that the apparatus is in the active state when the power consumption increases between subsequent measurements. When temperature is measured in the at least two heating zones, the processor may be configured to determine that the hair contacts the first heating and cooling zone before the second heating and cooling zone by determining that the temperature in the first heating zone has decreased between subsequent measurements more than the temperature in the second heating zone. Similarly, when temperature in the at least two cooling zones is measured, the processor may be configured to determine that the hair contacts the first heating and cooling zone before the second heating and cooling zone by determining that the temperature in the first cooling zone has increased between subsequent measurements more than the temperature in the second cooling zone. When the at least one sensor measures power consumption within the at least two heating zones, the processor may be configured to determine that the hair contacts the first heating and cooling zone before the second heating and cooling zone by determining that the power consumption in the first heating zone has increased between subsequent measurements more than the power consumption in the second heating zone. Where the temperature in the heating zone is measured, the processor may be configured to regulate the power supply to the heating zone to regulate the temperature of the heating zone.

Each of these sensor and processor arrangements may be used alone or in conjunction with other embodiments.

Thus according to another aspect of the invention, there is provided a hair styling apparatus comprising a first and a second arm moveable between a closed position in which a contacting surface of the first arm is adjacent a contacting surface of the second arm and an open position in which the contacting surfaces of each arm are spaced apart, whereby in use, a section of hair is clamped between the contacting surfaces when the arms are in the closed position;

a heating zone on at least one of the contacting surfaces for heating the section of hair between the contacting surfaces;

a cooling zone having a curved cooling portion adjacent the heating zone for cooling and curling the section of hair after the section of hair has been heated, at least one sensor providing sensor data and a processor which is configured to receive said sensor data;

process said sensor data to determine whether the hair styling apparatus is in an active state in which the hair styling apparatus is being used to curl hair or in a passive state in which there is no curling;

determine whether or not the hair styling apparatus has changed between the active and passive states and if the state has changed, control the heating zone to change the temperature in the heating zone.

According to another aspect of the invention, there is provided a hair styling apparatus for comprising a first and a second arm moveable between a closed position in which a contacting surface of the first arm is adjacent a contacting surface of the second arm and an open position in which the contacting surfaces of each arm are spaced apart, whereby in use, a section of hair is clamped between the contacting surfaces when the arms are in the closed position;

at least a first and second heating zone for heating the section of hair between the contacting surfaces;

at least a first and second cooling zone having a curved cooling portion for cooling and curling the section of hair after the section of hair has been heated, wherein the first cooling zone is adjacent the first heating zone and the second cooling zone is adjacent the second heating zone, at least one sensor providing sensor data and a processor which is configured to receive said sensor data;

process said sensor data to determine whether the hair styling apparatus is in an active state in which the hair styling apparatus is being used to curl hair or in a passive state in which there is no curling;

determine whether hair contacts the first heating and cooling zone before the second heating and cooling zone or vice versa.

The curved recess has a curved base and a surface of the curved ridge which is adjacent the curved base when the jaws are closed may be an insulated zone. This can help reduce unwanted banding and also changes the heater path length. Furthermore, this feature ensures that any curved surfaces are either insulated or are actively cooled—i.e. the cooling regions. No curved surfaces are heated which is different for to a crimping iron which is another hair styling apparatus which imparts curves/waves to the hair. As explained above, the heating regions are preferably planar to ensure better contact and heat transfer. The curved insulated zone can be used as a stand-alone feature or in conjunction with other features.

Thus according to another aspect of the invention, there is provided a hair styling apparatus comprising a pair of closable jaws to engage a user's hair;

wherein said jaws have complementary shapes, a first said jaw defining a curved ridge and a second said jaw defining a curved recess; and wherein one or both of said jaws includes a heater such that, when said jaws are closed, hair is heated in a heating region between the ridge of said first jaw and the recess of said second jaw;

wherein said second jaw has a curved longitudinal surface having an active cooling region;

wherein a transverse cross section through said second jaw defines at least one S-shaped curve having a forward curve into which said ridge of said first jaw fits, and a linked reverse curve bearing said active cooling region on which hair may be cooled and curved;

wherein the curved recess has a curved base and a surface of the curved ridge which is adjacent the curved base when the jaws are closed is an insulated zone.

This may be alternatively expressed as a hair styling apparatus comprising a first and a second arm moveable between a closed position in which a contacting surface of the first arm is adjacent a contacting surface of the second arm and an open position in which the contacting surfaces of each arm are spaced apart, whereby in use, a section of hair is clamped between the contacting surfaces when the arms are in the closed position;

a heating zone on at least one of the contacting surfaces for heating the section of hair between the contacting surfaces; and a cooling zone having a curved cooling portion adjacent the heating zone for cooling the section of hair after the section of hair has been heated, wherein the second arm comprises a channel having a base and sides;

wherein a section of the first arm is received within the channel on the second arm, the section having a profile which is complementary to the profile of the channel, the section having an upper surface and sides, wherein at least the sides of the channel and the sides of the section are the contacting surfaces of each arm and the upper surface of the section is an insulated zone.

There is a minimum threshold of moisture content which is required if the hair is to be stressed and then cooled (generating a curl) and if the hair is heated for too long, the moisture content will reduce below this minimum threshold (reducing the efficiency of the curling process). Accordingly, it is preferred that the heating zone in which the hair is heated has a path length of less than 70 mm, preferably approximately 20 mm. The sides of the channel/recess and the sides of the section/ridge form two pairs of contacting surfaces and at least one of these pairs of contacting surfaces (possibly both) comprises a heating zone. Providing an insulated zone between the two pairs of contacting surfaces ensures that hair is not heated in the insulated zone so regardless of whether there are one or two heating zones, the heater path length is reduced by including the insulated zone.

The insulated zone may have a curved profile. The curved profile may have a large radius of curvature. A curved profile may reduce conflicting directions of stress to the hair and may reduce the risk of a kink being generated in the initial clamping phase before movement along the hair. The insulated zone may be made from an insulating material, e.g. plastics and may further comprise a layer of different insulating material.

The or each heating zone of each embodiment may comprise a separate heating assembly. The insulated zone may comprise two insulated sections, one mounted to each heating assembly. The mounting mechanism may be designed to reduced heat transfer. For example, the mounting mechanism may comprise a connector having high heat resistance and/or a layer of insulating material (e.g. aerogel) may be mounted between each heating assembly and each insulated section.

In all the embodiments, it is preferred for there to be a firm contact at the contacting surfaces to increase the efficiency for styling purposes. However, the arms also need to be relatively easy to move between the open and closed positions. If the contact is too tight between the contacting surfaces, frictional forces may make it difficult to open and close the arms. However, if the contact is too loose, the hair will not be stressed and the heating will not be efficient. This may be achieved by the section/ridge of the first arm/jaw comprising two separate assemblies, a first assembly comprises a first side of the section and a second assembly comprises a second side of the section. Where both the first and second sides comprise heating zones, the assemblies may be the heating assemblies.

Thus according to another aspect of the invention, there is provided a hair styling apparatus comprising a first and a second arm moveable between a closed position in which a contacting surface of the first arm is adjacent a contacting surface of the second arm and an open position in which the contacting surfaces of each arm are spaced apart, whereby in use, a section of hair is clamped between the contacting surfaces when the arms are in the closed position;

wherein the second arm comprises a channel having a base and sides;

wherein the first arm comprises a section which is received within the channel on the second arm, the section having a profile which is complementary to the profile of the channel, the section comprising an upper surface and two sides with at least the sides of the channel and the sides of the section being the contacting surfaces of each arm;

wherein the section of the first arm comprises two assemblies mounted to allow movement relative to each other; wherein a first assembly comprises a first side of the section and a second assembly comprises a second side of the section and the apparatus further comprising a heating zone on at least one of the contacting surfaces for heating the section of hair between the contacting surfaces; and a cooling zone having a curved cooling portion adjacent the heating zone for cooling the section of hair after the section of hair has been heated.

The movement may be between a first position (in the closed position) in which the sides of the section are biased against the sides of the channel to ensure a good contact with the hair and second position (moving from the closed position to the open position or vice versa) in which the assemblies are closer together to reduce friction between the sides to allow the arms to be moved apart or together. Thus in essence, the mechanism is a biasing mechanism.

Alternatively, the same effect can be achieved by another embodiment of the invention, a hair styling apparatus comprising a first and a second arm moveable between a closed position in which a contacting surface of the first arm is adjacent a contacting surface of the second arm and an open position in which the contacting surfaces of each arm are spaced apart, whereby in use, a section of hair is clamped between the contacting surfaces when the arms are in the closed position;

a heating zone on the contacting surface of each of the first and second arms for heating the section of hair between both heating zones of the contacting surfaces;

a cooling zone having a curved cooling portion adjacent each heating zone for cooling and curling the section of hair after the section of hair has been heated, and a biasing mechanism which maintains the heating zone of the contacting surface on the first arm parallel to the second arm, wherein the first arm comprises a heating element having a first surface which provides the heating zone and a second surface to which the biasing mechanism is attached.

Any known mechanism which controls this movement may be used or is a biasing mechanism. One suitable mechanism comprises mounting at least one end of each assembly (preferably both ends) in a block wherein the blocks are joined by a resilient member (e.g. a spring). The blocks may be housed in a housing and the blocks may slide within a groove in the housing. Alternatively, the biasing mechanism may comprise at least one spring. The biasing mechanism may comprise four springs, one mounted adjacent each corner of the second surface of the or each heating element and a corresponding recess for each spring wherein movement of each spring is controlled by constraining each spring within the corresponding recess. The biasing mechanism may comprise at least one (preferably two) end cap which comprise at least one (preferably two) corresponding recess.

As set out above, in all the embodiments, it is necessary for the cooling zones to be at a lower temperature than the heating zones to enable curling. Accordingly, in practice, heat needs to be drawn away from the cooling zones. This may be achieved where there at least two cooling zones by using a heat sink which is connected to each cooling zone by a separate heat pipe.

Thus according to another aspect of the invention, there is provided a hair styling apparatus comprising

- a first and a second arm moveable between a closed position in which a contacting surface of the first arm is adjacent a contacting surface of the second arm and an open position in which the contacting surfaces of each arm are spaced apart, whereby in use, a section of hair is clamped between the contacting surfaces when the arms are in the closed position;
- at least two heating zones for heating the section of hair between the contacting surfaces; the hair being heated between contacting surfaces;
- a cooling zone having a curved cooling portion adjacent each heating zone for cooling the section of hair after the section of hair has been heated,
- at least one heat sink and
- one or more heat pipes extending from each of the cooling zones to the at least one heat sink.

The use of a separate pipe for each cooling zone means that large bends in the heat pipe which reduce the efficiency may be eliminated. The diameter of each separate pipe may be relatively small, e.g. 3 to 7 mm, ideally 5 mm. For passively cooling the heat sinks, the combined surface area of the pipes and heat sink may be between 90 $cm^2$ to 350 $cm^2$, preferably around 210 $cm^2$. A smaller heat pipe diameter may result in a more cost effective design because less material is required to manufacture the heat pipe. The apparatus may comprise two heat sinks at opposed ends of the apparatus, wherein the heat pipes are connected to both heat sinks.

The apparatus may comprise a high pressure air system and a processor which may be configured to trigger a high pressure air system to deliver air to the most efficient position within the apparatus. The apparatus may further comprise a product system and a processor which may be configured to trigger product to deliver air to the most efficient position within the apparatus. The apparatus may further comprise a cut-out mechanism and a processor may be configured to trigger the cut-out mechanism when the processor determines that the temperature of the cooling system is above a threshold, e.g. a limit between 70 to 100 degrees C. The processor for each of these systems and mechanisms may be the same as the processor mentioned above or a different one.

According to another aspect of the invention, there is provided a method of manufacturing a heating assembly for hair styling apparatus comprising:

- forming a housing having a base and two sides which define a cavity having an opening;
- inserting a heater through the opening into the cavity of said housing;
- wherein said cavity has a profile matching that of the heater whereby said heater is a snug fit within the cavity.

The heater assembly manufactured by this method may be used in the hair styling apparatus described previously or described below.

The housing may be formed by extruding a material, e.g. a conductive material such as aluminium. The housing must have good thermal conductivity to ensure that heat from the heater is transferred through the housing walls to the contacting surface in the heating zone(s). The thickness of the extruded material may not be constant so as to provide tolerance improvement. For example, the thickness of the material forming the housing may be greatest at the base and least at the opening and the thickness may gradually taper from the base to the opening. Such gradual decrease of the thickness may minimise the risk of work hardening the material (e.g. aluminium) over time.

The base may comprise a hinge point which allows the sides to move relative to each other. This may provide another mechanism for tolerance improvement, in particular for allowing tolerances in the matching of the heater shape with the shape of the cavity in the housing.

A thermally conductive medium may be inserted between the heater and the housing. Such a medium is designed to increase the thermal conductivity between the heater and the housing. This thermally conductive medium may be a thermal grease which may be applied to the outer surfaces of the heater before its insertion in the cavity. Alternatively, the thermally conductive medium may be a sheet of conductive material. The sheet may be inserted between the heater and the inner walls of the cavity by covering the opening of the housing with the sheet before inserting the heater whereby the sheet is pushed into place as the heater is inserted into the cavity. The sheet may be made from any thermally conductive material, e.g. graphite.

The heater may comprise a plurality of layers which are laminated together. For example, the heater may comprise a sensor layer having a plurality of sensor elements and a heating layer having a plurality of heating elements. The heater may be inserted into the housing such that, in use, said sensor layer is between the heating layer and a user's hair. Placing the sensor between the hair and the heating element allows the apparatus to maximise the thermal response and minimise damage to a user's hair.

The heater(s) is preferably small, for example having a total length of approximately 20 mm. The use of a housing and optional thermally conductive medium ensures that although the heater is small, high power can still be achieved. Furthermore, the method of manufacture is relatively simple.

The heating zone may also have an insulated curved region. The insulated curved region may be formed as a flange which protrudes from the heating zone. The flange may stress, and thereby commence curling of the hair during heating. The insulating flange may have a thickness which is substantially equal to the offset distance. The heating portion may have a wing angle of between 0° and 60°, in particular 28°. The curved insulating portion may have a radius of curvature of between 1 mm and 6 mm, in particular 2 mm. The curved cooling portion may have a radius of curvature of between 2 mm and 10 mm, in particular 6 mm. The offset distance between the zone suitable for cooling and the zone suitable for heating may be between 0 mm and 15 mm, in particular 0.5 mm, further details of which are set out with reference to the first aspect of the invention.

According to a still further aspect of the invention there is provided a method of cooling hair in a hair styling apparatus. The hair styling apparatus comprises a first and a second arm moveable between a closed position in which a contacting surface of the first arm is adjacent a contacting surface of the second arm and an open position in which the contacting surfaces of each arm are spaced apart. In use, a section of hair is clamped between the contacting surfaces when the arms are in the closed position. The hair styling apparatus further comprises a heating zone on at least one of the contacting surfaces for heating the section of hair between the contacting surfaces. The method comprises transferring heat from the section of hair after being heated by the heating zone to another section of hair before said another section of hair is heated by the heating zone. Such a method allows the heated hair to in effect be cooled by the incoming hair.

BRIEF DESCRIPTION OF THE DRAWINGS

For a better understanding of the invention and to show how it may be carried into effect reference shall now be made, by way of example only, to the accompanying drawings in which.

DETAILED DESCRIPTION OF PREFERRED EMBODIMENTS

Throughout the specification, the terms hair styler and hair styling apparatus are used interchangeably for a device which is used to style hair, i.e. to straighten or curl hair. As the skilled person will appreciate, during styling, hair is under tension between the user's head and the styling apparatus. In some of the Figures, styled hair is shown exiting the styling apparatus curled—this is purely for illustrative purposes to shown the effect on the hair once it has moved through the styling apparatus. During styling to create curls, the shape of the curl is retained in the plastic memory of hair and the curl appears when the hair is no longer under tension, i.e. when the hair is released from the styling apparatus.

Conventional hair straighteners/stylers typically comprise a pair of arms hinged together at one end with each arm supporting a heatable plate. The arms are moveable between a closed position in which the opposed ends of the arms are adjacent each other so that the heatable plates are in contact with hair clamped between the arms and an open position in which the opposed ends of the arms are spaced apart. Variants may not comprise a hinge, but still allow for the arms to be moved between open and closed positions.

Figure 1:
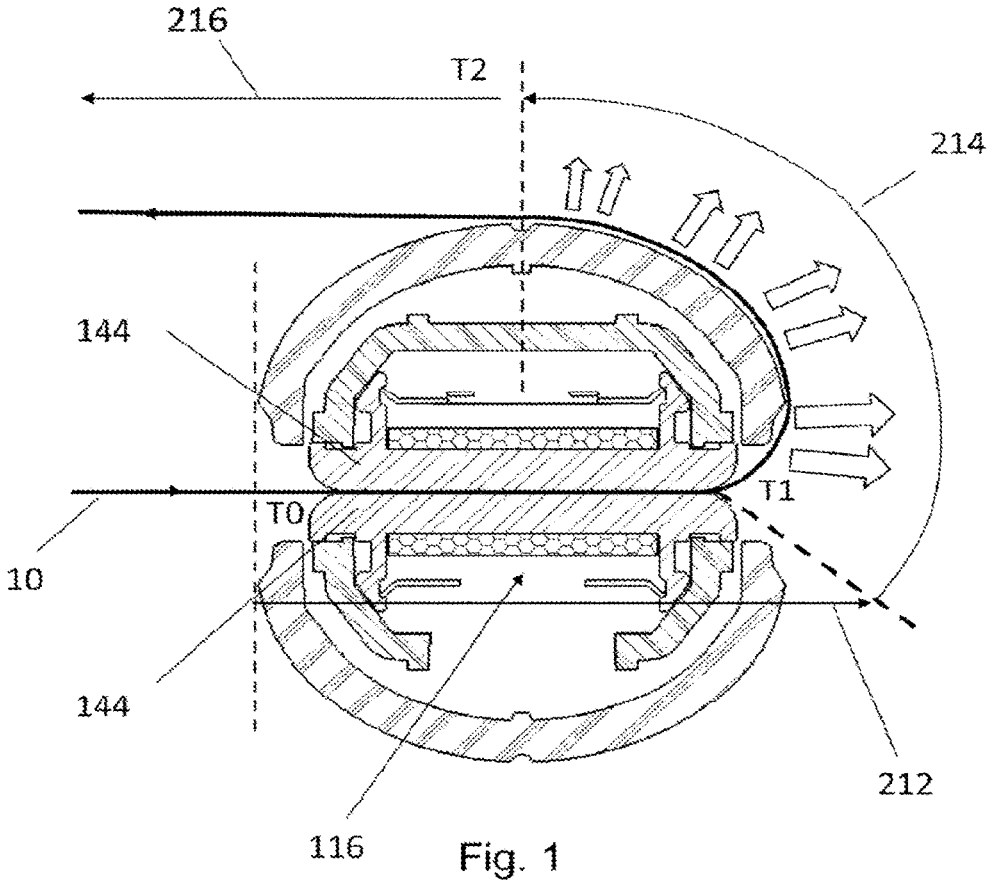
Fig. 1 (Prior art)
FIG. 1 illustrates a conventional approach to hair curling using a hair straightener.

FIG. 1 diagrammatically illustrates a conventional approach to hair curling using a hair straightener. The hair straightener comprises a pair of arms each carrying a heatable plate 144. The arms are shown in the closed position clamping a quantity of hair 10 between the hot heatable plates 144. To style hair, the apparatus is moved relative to the hair in the direction of arrow 212. Arrow 212 shows the direction of movement of the hair although the straightener moves in the opposite direction. Hair is kept under tension through the heatable plates which form a heating zone 116 from T0-T1. As the hair passes through the heating zone, this prepares the hair for styling. Once the temperature of hair exceeds the hair glass transition temperature of approximately 147° C., the hair becomes mouldable (plastically deformable). If the hair is simply passed straight through the heatable plates this would mould the hair into a straightened form.

To use such a hair straightening device to curl hair, the hair straightener/styler is turned through approximately 180° or more after clamping the hair between the arms and before moving the styler relative to the hair. As shown, this rotation pulls some of the hair 10 across the casing of one arm (from T1-T2 in FIG. 1). The curved outer surface of the hair straightener is then used to form a curl. Between T1 (exit from heatable plates) and T2 (point of maximum curvature on the casing) and along the path of arrow 214, the hair begins to cool, taking the form of the curved surface as the hair falls below the glass transition temperature. Thus, this zone may be termed a cooling zone 114. Beyond T2, the hair is straight under gravity and moves in the direction of arrow 216.

The casing for such conventional hair straighteners is typically made from a plastics material, such as rynite. Such plastic materials are generally poor thermal conductors and so the heated hair cools slowly. As explained in more detail in relation to FIGS. 8*a* and 8*b* below, such inefficient cooling means that the hair does not efficiently retain the shape of the casing. Furthermore, a user needs to rotate the device to create the curls and care needs to be taken regarding the direction of the turn to create curls curling in the same direction.

Figure 2A:
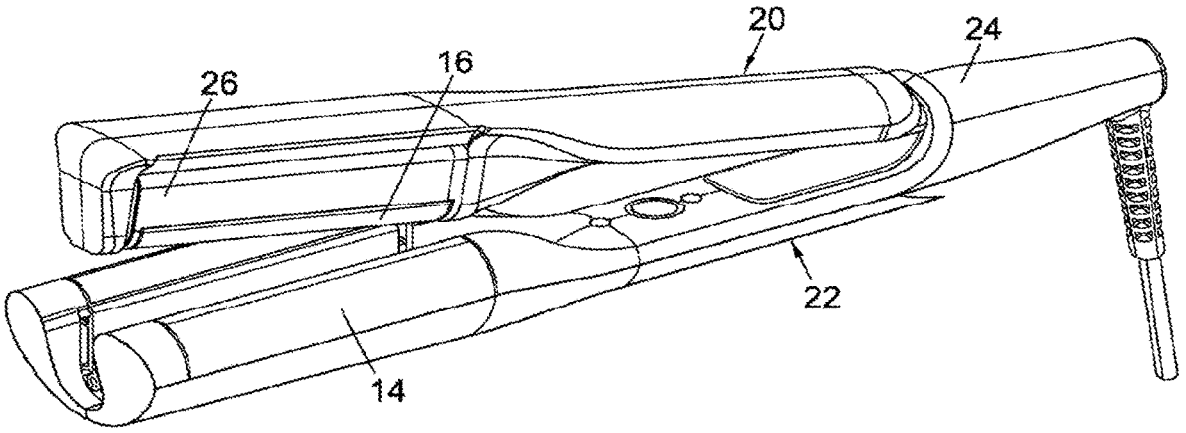
FIG. 2*a* shows a perspective view of a hair styler according to the present invention.
Figure 2B:
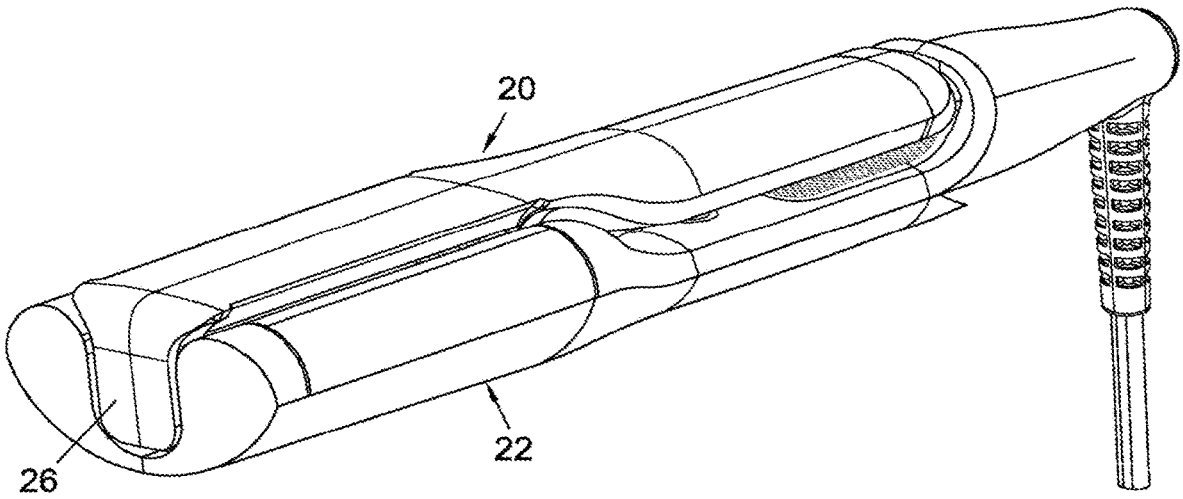
FIG. 2*b* shows a perspective view of the hair styler of FIG. 2*a* in a closed position.

FIGS. 2*a* to 6 show an illustrative arrangement of a hair styling apparatus which may incorporate one or more of the embodiments of the invention described in more detail below. The apparatus comprises a pair of arms 20,22 which are hinged together at one end 24. The arms are moveable between a closed position in which the opposed ends of the arms from the joined end are adjacent each other as shown in FIG. 2*b* and an open position in which the opposed ends of the arms are spaced apart as shown in FIG. 2*a*. Variants may not comprise a hinge, but still allow for the arms to be moved between open and closed positions. The first arm 20 is shaped so that the end of arm which is adjacent the end of the second arm 22 in the closed position fits into a corresponding recess 24 in the second arm. The recess 24 is a generally elongate open-ended channel which extends along the portion of the second arm which is in contact with the first arm. The axis of the channel is aligned with the axis of the arm, i.e. the channel extends longitudinally along the arm. The channel has a base and sides. The first arm 20 has a generally elongate section 26 which fits within the recess 24.

As shown in more detail in FIGS. 3*a* to 5 the first arm 20 has a pair of heating zones 16 with each heating zone 16 arranged to extend along at least a significant part of one long side of the elongate portion. The second arm also has a pair of heating zones 16' with heating zone 16' arranged to extend along at least a significant part of one long side of the recess 24. Thus, the heating zones 16, 16' extend longitudinally along the apparatus, i.e. parallel to the length or long axis of the apparatus. The heating zones 16 on the first arm are adjacent and generally in contact with the heating zones 16' on the second arm in the closed position. The contacting surfaces of the heating zones 16, 16' are aligned so that they are generally parallel to the direction of opening and closing the first and second arms. Each heating zone is heated by a respective heater 28. Each heating zone has a generally planar contacting surface and may be formed as a heating plate, e.g. from ceramics or metal, e.g. aluminium, which may/may not have a thermal coating.

The use of two parallel planar plates on each arm joined by a curved section is a general approximation to a pair of semi-circular heating plates. Curved heating plates do not generally achieve good contact with hair and curved portions in the heating zone can crimp the hair which is undesirable. Moreover, it is more practical to manufacture planar heating plates with greater engineering reliability. Accordingly, planar heaters should ideally be used in the heating zones. However, the approximation in FIG. 2*a* means that there is not a continuous curve and through the turn, across the top of the elongate section, the hair may be flattened. Insulators 520 are attached above the two heating zones of the first arm 20. As explained in more detail below with reference to FIGS. 17*a* and 17*b*, the insulators may prevent the apparatus forming an unwanted crimped band on hair which is on the top of the elongate section as the first and second arms are closed.

Figure 3A:
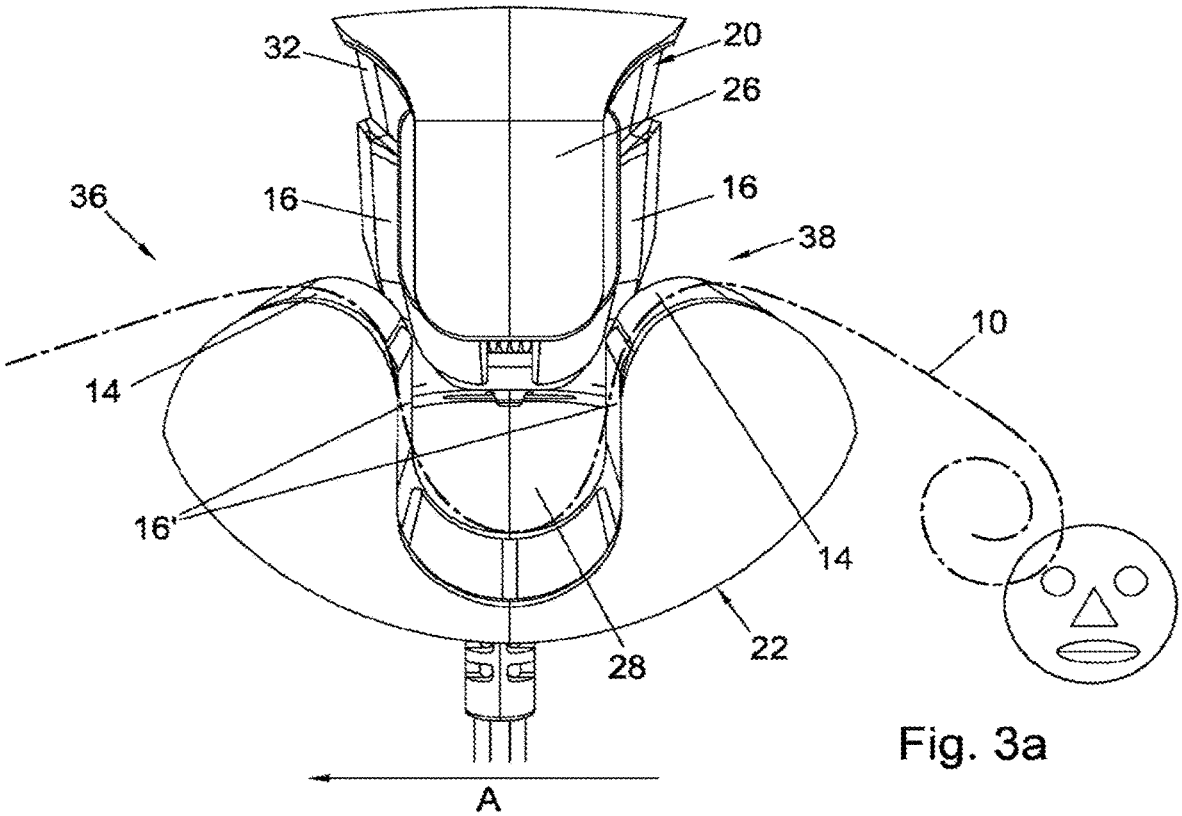
FIG. 3*a* shows an end view of the hair styler of FIG. 2*a* adjacent a user's head with the hair styler in a curling orientation.
Figure 4:
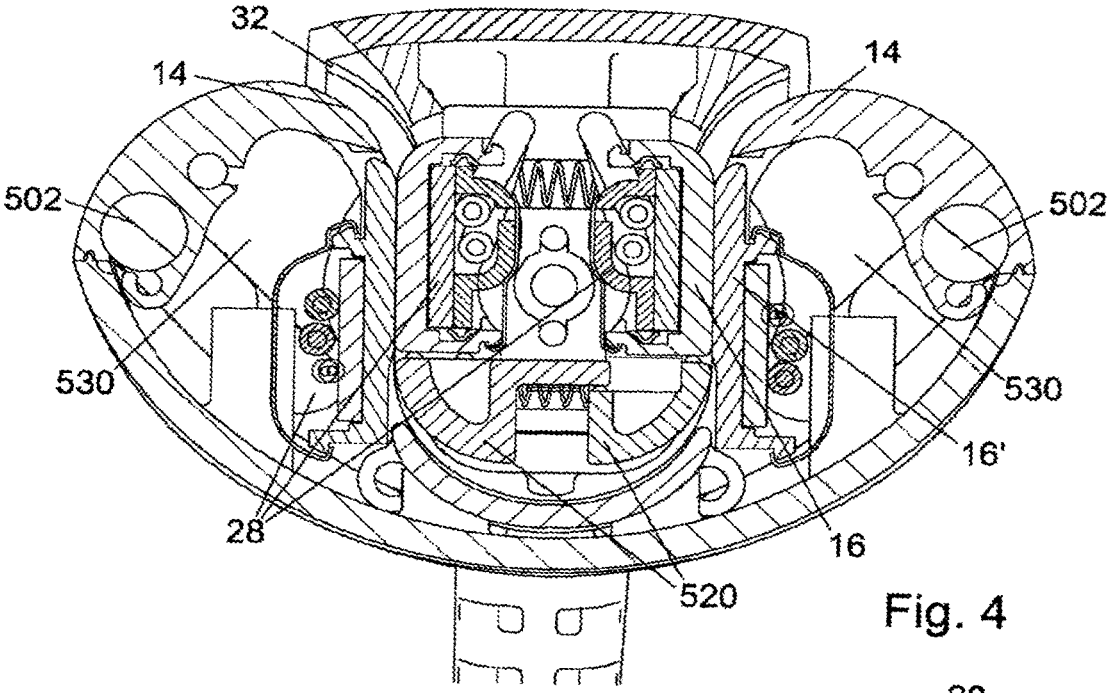
FIG. 4 shows a cross-section across the hair styler of FIG. 2*a;*
Figure 6:
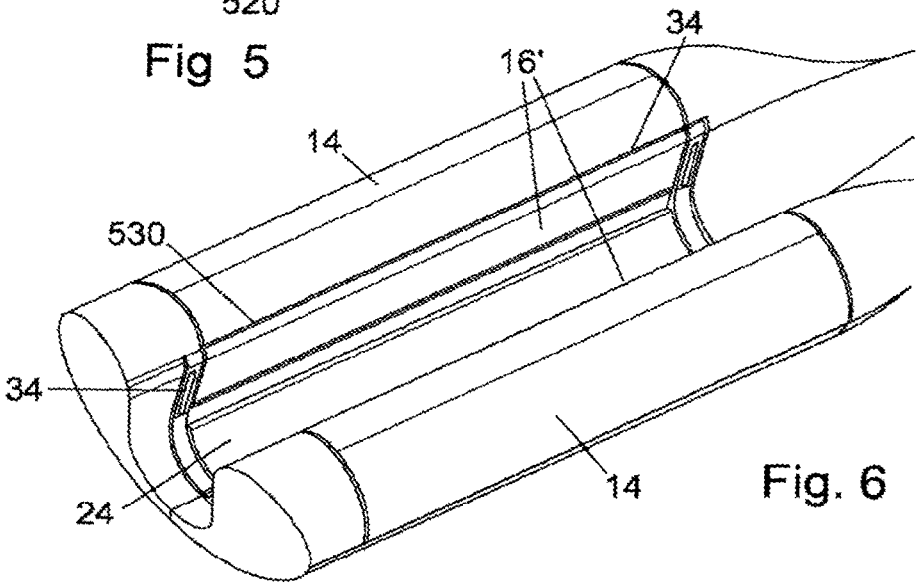
FIG. 6 shows a perspective view of the other arm of the hair styler of FIG. 2*a;*

As shown in more detail in FIGS. 3*a*, 4 and 6, the second arm 22 also has a pair of cooling zones 14 which are arranged with one adjacent to each heating zone 16'. The cooling zones 14 extend along the upper edges of the channel. The cooling zones are curved to curl hair which passes through the device. By providing a pair of cooling zones, hair can be curled by pulling the apparatus in either direction along the hair. There is a thermal zone 530 between each cooling zone 14 and each heating zone 16 to minimise unwanted heating of the cooling zone by the adjacent heating zone. Each cooling zone also has a heat pipe 502 passing therethrough which connected to a heat sink (not shown). This provides passive or active cooling so that the temperature in the cooling zones is positively reduced by a thermal control system rather than just by cooling to ambient air as explained in more detail below.

The first arm 20 is formed with a flange 32 on either side which extends along the elongate portion 26. The flanges 32 are curved with a shape, i.e. a concave curve, that is complementary to the curved cooling zones 14, i.e. the convex curve, on the second arm. However, the flanges 32 are relatively short and only extend across a part of the curved cooling zones on the second arm. As explained in more detail in relation to FIGS. 3*a* and 3*b*, the flanges help to guide the hair onto the curved cooling zones when the apparatus is in the curling orientation but allow the hair to be straightened when the apparatus is in the straightening orientation. In this embodiment, the flanges 32 are not positively cooled in contrast to the cooling zones on the second arm. The lack of positive cooling may reduce the risk of an experienced user creating a curl on the flange which is in a different direction to that of the curl created on the cooling zone of the second arm. However, in an alternative embodiment, the flanges could be cooled to form cooling zones on the first arm.

Figure 3B:
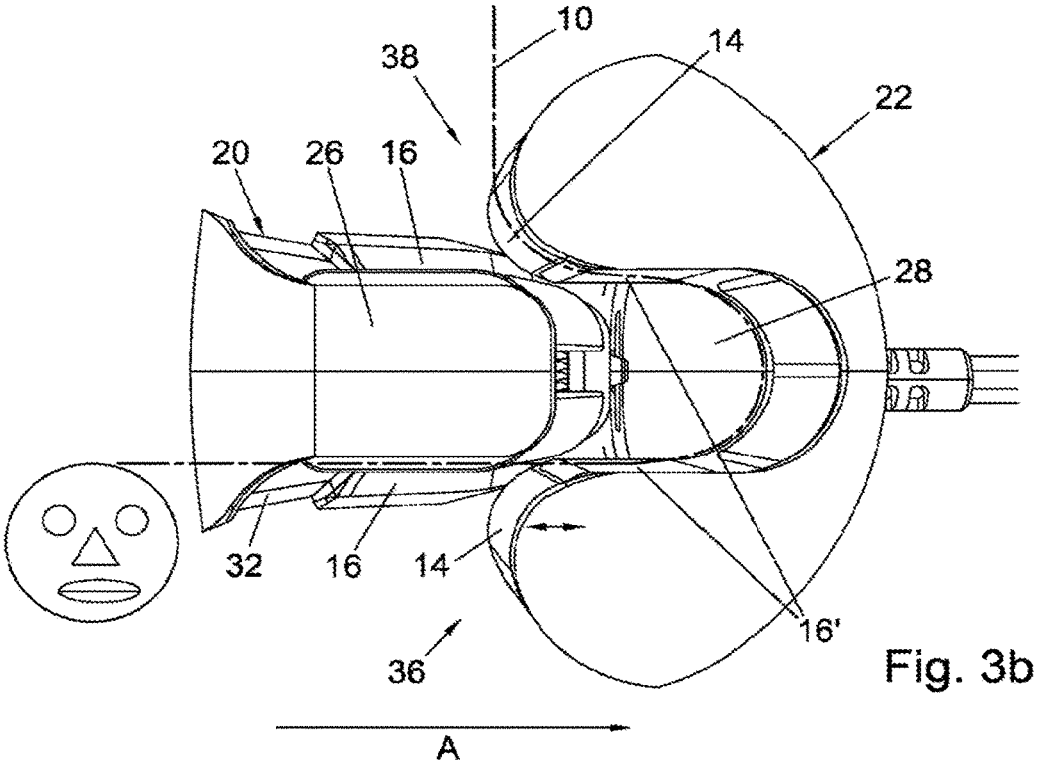
FIG. 3*b* shows an end view of the hair styler of FIG. 2*a* adjacent a user's head with the hair styler in a straightening orientation.

FIGS. 3*a* and 3*b* show how a user may use the apparatus to style hair. In both arrangements, a user places a lock of hair between the arms of the apparatus and moves the apparatus in a linear motion across the hair. As the hair moves relative to the apparatus, it passes first over a first cooling zone and then through the two plates of the first heating zone which make contact with the hair to heat the hair. It then passes through the two plates of the second heating zone with stress imparted on the hair as the hair exits the second heating zone.

In FIG. 3*a*, the apparatus is held in a curling orientation to curl hair. In the curling orientation, hair is in contact with and passes over the curved cooling zone after it exits the second heating zone. As shown, the curved cooling zone faces upwards so that the hair rests on the curved cooling zone under gravity. The flanges 32 help to guide the hair onto the curved cooling zone. The cooling accelerates the retention of the shape it is held in and the curl is held in the plastic memory of the hair memory while under tension. Keeping tension on the hair helps to keep the hair on the curved cooling zone. Although a schematic curl is shown in FIG. 3*a*, this would not appear until the hair was released from the device. The direction of opening and closing the arms is generally parallel to the direction of movement across a user's hair in the curling orientation. In other words, the plane of the planar heating zones is generally perpendicular to the direction of movement across the hair. This creates stress on the hair as it exits the second heating zone. As explained below, creating stress is a key factor in generating curls.

In FIG. 3*a*, the apparatus is held in a straightening orientation to straighten hair. In the straightening orientation, hair is held away from the curved cooling zone after it exits the second heating zone. As shown, the curved cooling zone faces sidewards so that the hair which is in tension has no or minimal contact with the curved cooling zone. This is permitted because of the relatively small size of the flanges 32 compared to the curved cooling zone. It will be appreciated that if the flanges extended across a significant proportion or all of the curved cooling zone, the hair would necessarily be cooled in the curved cooling zone. However, the use of the flanges allows a user to rotate the apparatus into an orientation in which the hair can avoid the curved cooling zone and can thus be straightened by the device. The direction of opening and closing the arms is generally perpendicular to the direction of movement across a user's hair in the straightening orientation. In other words, the plane of the planar heating zones is generally parallel to the direction of movement across a user's hair. This does not impart any stress on the hair instead the hair is pulled straight under tension and cools naturally in the ambient temperature to straighten the hair.

In both arrangements, the hair may be considered to be travelling from an inlet to an outlet of the device. The first cooling and heating zones are adjacent to the inlet and the second cooling and heating zones are adjacent to the outlet. Thus, as shown in FIG. 3*a*, if the styler is moved in the direction of arrow A across the hair 10, i.e. from right to left, the inlet 38 is on the right side of the styler and the outlet 36 is on the left side of the styler. As shown in FIG. 3*b*, the inlet 38 is on the upper side of the styler and the outlet 36 is on the lower side of the styler because the styler is rotated through 90 degrees relative to the orientation shown in FIG. 3*a*.

The apparatus is simple to use. The arms are opened and a lock of hair placed between the arms which are then closed. Depending on the orientation of the apparatus, the apparatus is then pulled across the hair to create a curl or straighten the hair. The motion is linear. Unlike conventional devices, there is no need to twist hair around the apparatus, style, release, then twist a further section of hair as required with conventional curling tongs with cylindrical heaters. However, a skilled user is not prevented from wrapping the hair around the device if they desire to create a different style.

Figure 5:
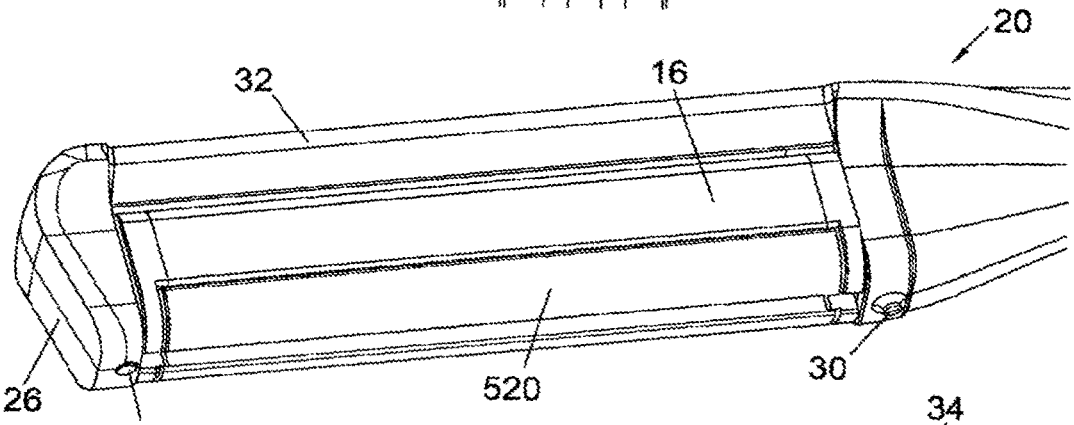
FIG. 5 shows a plan view of one arm of the hair styler of FIG. 2*a;*

Even though the device is simple to use, there is a potential problem in that hair placed within the apparatus may accidently slide off the heater plates within the heating zones. Accordingly, a guide 30 is attached to at least one of the arms to keep the user's hair in place. As shown in FIG. 5, the guide 30 is in the form of a pair of projections which project from the upper surface at opposed ends of the elongate portion 26. Thus, in this arrangement the projections are either side of the insulators 520 on the heating zone. The hair is retained between each projection to guide it through the heating zones. It will be appreciated that other guides could also be used to achieve the same effect.

As will be appreciated, the projections define a minimum spacing (typically 2 mm clearance to allow for thick hair) between the first and second arms 20, 22 when the arms are closed. Thus, the height of the projections may be selected so that the upper surface of the elongate portion 26 of the first arm does not contact the lower surface of the recess 24 on the second arm. This will assist in preventing friction between these two surfaces which may damage the insulators 520 and/or reduce friction on hair within the apparatus. In this minimum spacing, the arms are not pressing on the hair. It will be appreciated that the projections may also be formed on the surface of the recess or there may be projections on one or both arms.

As set out above, in the closed position, the heating zones 16 on the first arm are generally in contact with the heating zones 16' on the second arm. Too much contact between the heating zones 16,16' may cause the contacting surfaces to scratch each other which may damage the contacting surfaces which are the working surfaces. There also needs to be a small gap to allow the hair to pass through the device. Accordingly, as shown in FIG. 6, a spacer mechanism 34 may be used to ensure that a minimum spacing between the first and second arms is maintained, particularly for the elongate portion 26 within the recess 24. In this arrangement, the spacer mechanism 34 is in the form of two pairs of projections; one pair for each heating zone. The projections in each pair are at opposed ends of the recess, either side of a heating zone. It will be appreciated that the projections may also be formed at either end of the elongate portion on the first arm or there may be projections on one or both arms. It will also be appreciated that other combinations of projections or other arrangements could also be used to achieve the same effect.

The use of the projections for the guide and/or spacer mechanism ensures that the surfaces which are in contact and thus bearing against each other are either plastic on plastic or plastic on metal. This reduces damage to the heater plates in the heating zones.

Figure 7A:
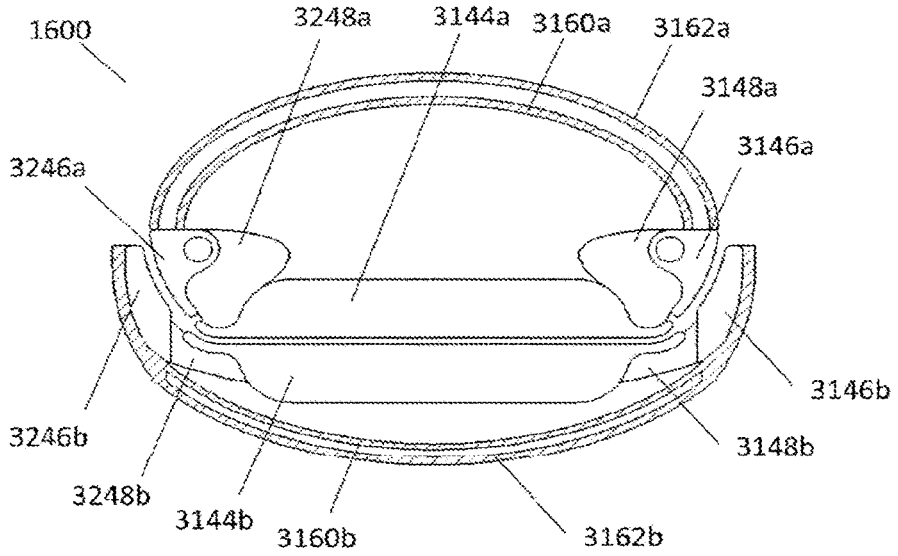
FIGS. 7*a* and 7*b* show schematic cross-section of variants of FIG. 2*a;*

FIG. 7*a* shows a schematic cross-section of a styling apparatus 1600 comprising a variation of the heating/cooling zone arrangement of FIG. 2*a*. The styling apparatus comprises a pair of arms each having a heating member 3144*a*, 3144*b* which together define a heating zone and a pair of cooling members 3146*a*, 3146*b* and 3246*a*, 3246*b* either side of each heating member to define a pair of cooling zones; one before and one after the heating zone. The apparatus comprises thermal insulation 3148*a*, 3148*b*, 3248*a* and 3248*b* forming a thermal zone which is preferably included to reduce heat transfer between the heating and cooling zones. An optional heat bridge 3160*a*, 3160*b* on each arm transfers heat between the cooling zones on the same arm. It will be appreciated that this can optionally be included in all embodiments. An outer casing 3162*a* on the upper arm, and outer casing 3162*b* on the lower arm cover the heat bridge. As in the arrangement of FIG. 2*a*, the contacting surfaces of each arm each have a complementary shape. However, in contrast to FIG. 2*a* embodiment, the arms have a complementary shape through both the heating and cooling zones and not just the heating zones.

Figure 7B:
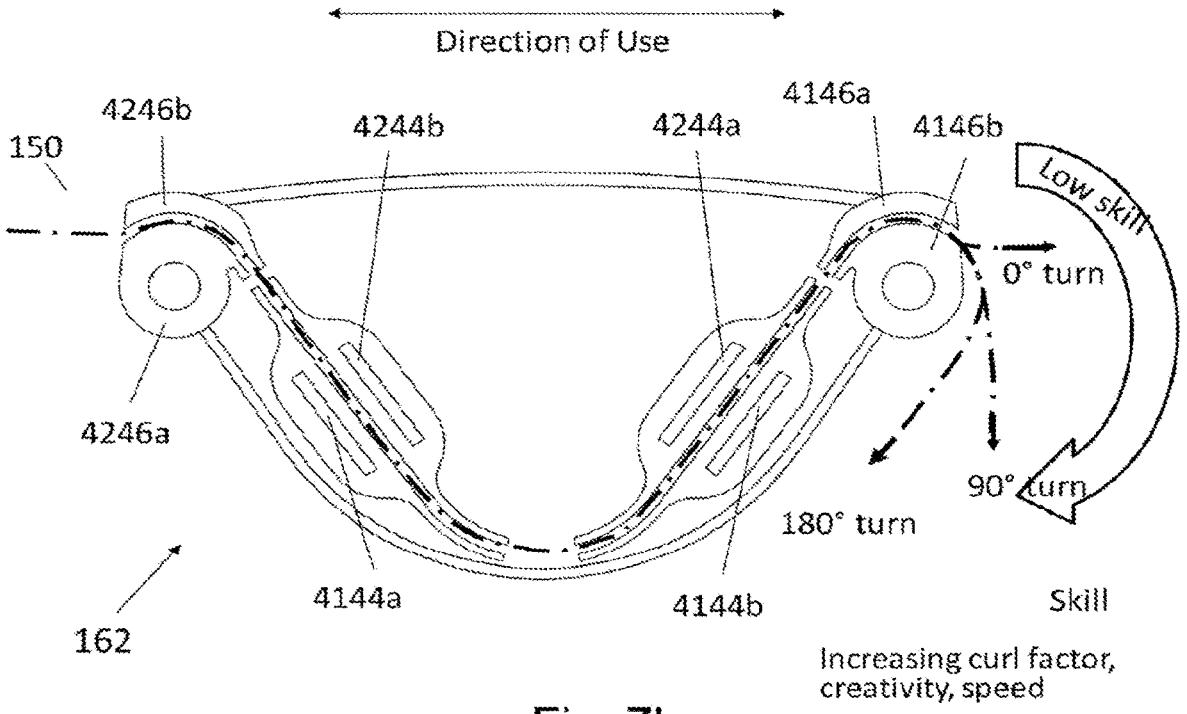

FIG. 7*b* shows another variant of the hair styling apparatus 162 in which the heating zone is angled relative to the direction of opening and closing the arms. Hair moves through styling apparatus along a generally "S" shaped path from first cooling (preheating) zone to heating zone, then a reversed "S" shaped path from the heating zone and through the cooling zone. The apparatus still comprises complementary profiles for the contacting surfaces but the planar contacting surfaces in the heating zones are set at an angle and thus each arm has a different cross-section. One arm has a generally domed central section which fits into a corresponding recess in the other arm. The planar contacting surfaces of the heating zones define the sides of the domed section. In this illustrative embodiment the hair enters and exits the hair styling apparatus along the same plane, although this is not essential On each arm, the heating zone may be formed from two separate heating members 4244*a*, 4144*a*, 4244*b*, 4144*b*, each having a central portion having a generally planar contacting surface and angled or curved portions in the form of flanges either side of the central portion. In this embodiment, there are two separate heating members on each arm and thus only one curved portion of each heating member is adjacent a cooling member 4246*a*, 4146*a*, 4246*b*, 4146*b*; the other curved portions of the heating members are adjacent a curved portion of the adjacent heating member. At adjacent sides, the cooling zone and heating zone curve in the same direction. Thus, the heating zone "flows" into the cooling zone through a continuous curve (or angle) in the same direction, with bending of the hair commencing in the heating zone, before entry into the cooling zones.

Both the heater zone arrangements of FIGS. 2*a* and 7*b* impart a turn on the hair which is not possible with the arrangement of FIG. 7*a*. Imparting a turn makes it easier for a user to style curls. Both the arrangements in FIGS. 2*a* and 7*b* may have heater path lengths of approximately 20 mm.

In FIG. 7*b*, three examples of pulling hair 150 through the styler 160 are show: one with a 0° turn, another with a 90° turn and another with a 180° turn. The greater the turn, the longer the period of contact the hair has with the cooling member, leading to a greater curl factor. In use, the longer periods of contact may be achieved by turning the hair styler relative to the head. Depending on the skill of the user, they may then be able to control or adjust the curl factor by varying the level of turning of the hair styler relative to a person's head. As set out above, a skilled user may also use these turns with the embodiment of FIG. 7*a*. However, one benefit of the arrangement in FIG. 2*a* or 7*b* is that hair may exit the styler in the same direction as it enters, meaning that the styler can be "slid" along the hair, without any relative rotation of the styler to the hair or head. This is shown by the 0° hair path line in FIG. 7*b*.

The term "curl factor" is used to define the ratio of the length of straight to curled hair. The higher the curl factor, the greater the curl. Generally speaking, the smaller the radius 'r' of the curved cooling member (see FIG. 3*a*), the tighter the curl produced, i.e. the curl factor improved as the radius of the curved cooling members decreases. Moving from a 16 mm radius to a 10 mm improves the curl factor by approximately 20% meaning that tighter curls are produced. Moving from a 16 mm radius to a 6 mm radius curve on the cooling members improves the curl factor by approximately 60%—even tighter curls. Setting the cooling members in the cooling zone to a radius between 2 mm to 10 mm has been observed to provide pleasing curls. One preferred radius 'r.' of the curve cooling members is 6 mm. These described radii similarly apply to all arrangements comprising curved cooling zones. However it has also been observed that other factors have an effect on this curl factor; these include variations in the heating, cooling, and curving of the hair in the styling appliance as well as changing the stress point radius on the heater outlet.

Figure 8A:
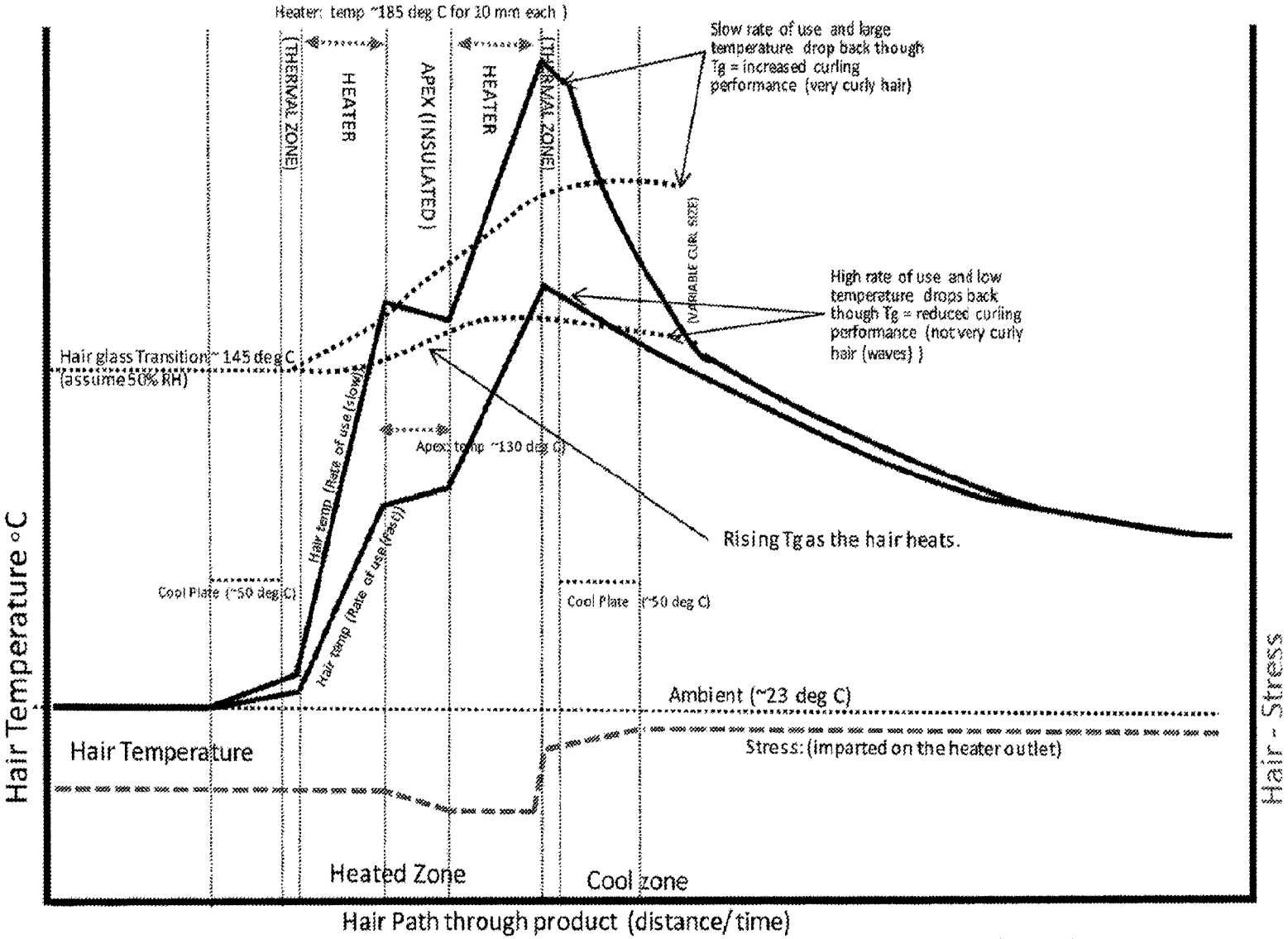
FIG. 8*a* shows a chart illustrating variation in temperature and stress for hair being styled using the hair styler of FIG. 2*a;*

The chart in FIG. 8*a* plots the change in hair temperature and the change in hair stress (dashed line) as hair is pulled through the hair styling apparatus of FIG. 2*a*. The left vertical axis defines hair temperature and the right vertical axis defines hair stress (the force applied to bend hair into the curled form). The change in stress is plotted below the change in hair temperature which is shown relative to ambient temperature. The horizontal axis defines the hair path or time through the styler. The horizontal axis is further divided into zones, denoted by vertical dotted lines dividing up the chart. Each zone signifies a different region relative to the hair styler. From left to right:

First Zone denotes characteristics of the hair before it enters the styling apparatus;

Second Zone denotes characteristics of the hair as it is pulled through the first cooling zone;

Third Zone (thermal zone) denotes characteristics of the hair as it is pulled through the first thermal zone;

Fourth Zone (heater) denotes characteristics of the hair as it is pulled through the first heating zone;

Fifth Zone (apex) denotes characteristics of the hair as it passes across a thermal insulation zone separating the first and second heating zones;

Sixth Zone (heater) denotes characteristics of the hair as it is pulled through the second heating zone;

Seventh Zone (thermal zone) denotes characteristics of the hair as it is pulled through the second thermal zone;

Eighth zone denotes characteristics of the hair as it is pulled through the second cooling zone after it has been heated; and Final Zone denotes characteristics of the curled and styled hair after it has exited the hair styling apparatus.

As set out above, the change in temperature is plotted relative to ambient temperature which is thus the lowest value on the left vertical axis. The cooling zones may initially be at ambient temperature when the power is off, but over time the temperature may change depending on the heat absorbed from the hair and the level of cooling and efficiency of heat extraction. By way of illustration the temperature of the cooling zones is therefore shown at an elevated temperature, above ambient. Preferably the cooling zones are cooled to allow hair to be cooled to around 90° C. or possibly more. In embodiments this may be achieved by limiting the temperature of the cooling zones in arrangements to a maximum 40 to 50° C. at a room temperature of 25° C. (or a temperature which is 25 degrees above ambient, preferably less). In FIG. 8*a*, the cooling zone is marked as having a temperature of approximately 50° C. In general, the cooling zones should reach equilibrium temperature of about 20 degrees above ambient when the product is switched on but not styling hair and about 25 degrees above ambient when in use.

The hair glass transition zone is illustrated on the graph with a dotted line. This zone defines the range of temperatures, between $T_{g1}$ and $T_{g2}$, in which the hair starts to become pliable and mouldable. The hair glass transition temperature is initially approximately 145° C. but as the hair is heated, the glass transition temperature rises. It rises more quickly for a slow rate of use and is more steady for a high rate of use because the high rate of use does not heat the hair to as high a temperature. The amount of energy which is absorbed by hair decreases with temperature. The specific heat capacity of hair is 1.3 J/gk as it is heated up to 100° C. but drops to 0.94 j/gk above 100° C. The temperature of the heating zones is at an elevated temperature, for example 147° C. or higher, and in this example is marked at 185° C. for both zones. This elevated temperature is above the upper limit for the glass transition zone so that hair can be heated to above the lower limit for the glass transition zone.

The first higher plot line in FIG. 8*a* illustrates the change in temperature of a section of hair that is pulled through the hair styler of FIG. 2*a* at a first rate to generate curls. There is only a small increase in the temperature of the hair as it passes through the first cooling zone and the first thermal zone. This first rate of pulling hair through the styler is sufficiently slow such that the hair is heated to above the glass transition zone in the first heating zone. In the insulation zone, the temperature drops a little and drops below the glass transition temperature which has increased because the hair has been heated. Accordingly, it is necessary to further heat the hair in the second heating zone to bring the temperature of the hair back above the glass transition zone temperature so that the hair is now pliable and ready for styling. On exiting the heating zone, the hair begins to cool as it is first no longer heated in the thermal insulation zone, then cooled in the cooling zone. The hair is still above the upper limit for the glass transition zone when it enters the cooling zone and is thus still pliable. As shown, there is then a rapid temperature drop in the second cooling zone which increases curling performance.

The second lower plot line in FIG. 8*a* illustrates the change in temperature of a section of hair that is pulled through the hair styler at a faster, second, rate than the other plot line. Again, there is only a small increase in the temperature of the hair as it passes through the first cooling zone and the first thermal zone. Furthermore, the rate is too fast for the hair to be heated above the glass transition zone in the first heating zone. There is a small change in temperature through the insulation zone and here it can be observed that the upper limit for the glass transition is only just reached in the second heating zone because the hair has remained between the contacting surfaces of the heating members for only just enough time. However, it is still above the lower limit for the glass transition zone as the hair enters the cooling zone. As a consequence of pulling hair through the hair styling apparatus too quickly, the temperature of the hair dips does not have a large temperature drop in the cooling zone and thus wavy or less curly hair is generated. A faster rate of pulling, faster than this second rate, could result in the hair being insufficiently heated and/or insufficiently cooled in order to effectively style. This may then lead to poor quality curling and/or reduced curling performance that fails to last.

For curling, a suitable rate may be between 10 and 45 mm/s with the slower rate shown in FIG. 8*a* being 10 mm/s and the higher rate 45 mm/s. A typical speed may be 20 mm/s. At a speed of 20 mm/s, the period of styling each section of hair (for normal length hair) will be approximately 57 seconds. This is the time taken by a typical professional user which includes the use and preparing for the next section. Clearly the time will also be dependent on the length of hair. It will be appreciated that these rates and times are dependent on many factors, particularly on the mass of hair being pulled through the device. The example rates above are for a typical section of hair, i.e. 0.15 g/cm. Using small sections of hair, for example 0.075 g/cm will enable faster product use. The user may thus be able to create tighter or looser curls by altering the rate at which they draw the product through the hair. The amount of hair within the styler will also clearly affect the curls created. For example, if a user places 0.12 g/cm of hair within the styler, beach waves (i.e. curls of large radius) may be created. At 0.047 g/cm, mid tightness curls may be created and tight curls may be created by placing on 0.028 g/cm within the styler. The general principles described in relation to FIG. 8*a* may apply to all embodiments, in particular the heating and cooling temperatures mentioned above.

The right vertical axis defines the relative stress applied to the hair. Imparting the correct stress is key to efficiently forming curls. As shown, the apparatus is designed so that the stress on the hair is reduced as the hair passes over the insulation zone but there is a rapid increase (step change) at the exit of the second heating zone. There is also an increase through the thermal zone and into the second cooling zone.

Figure 8B:
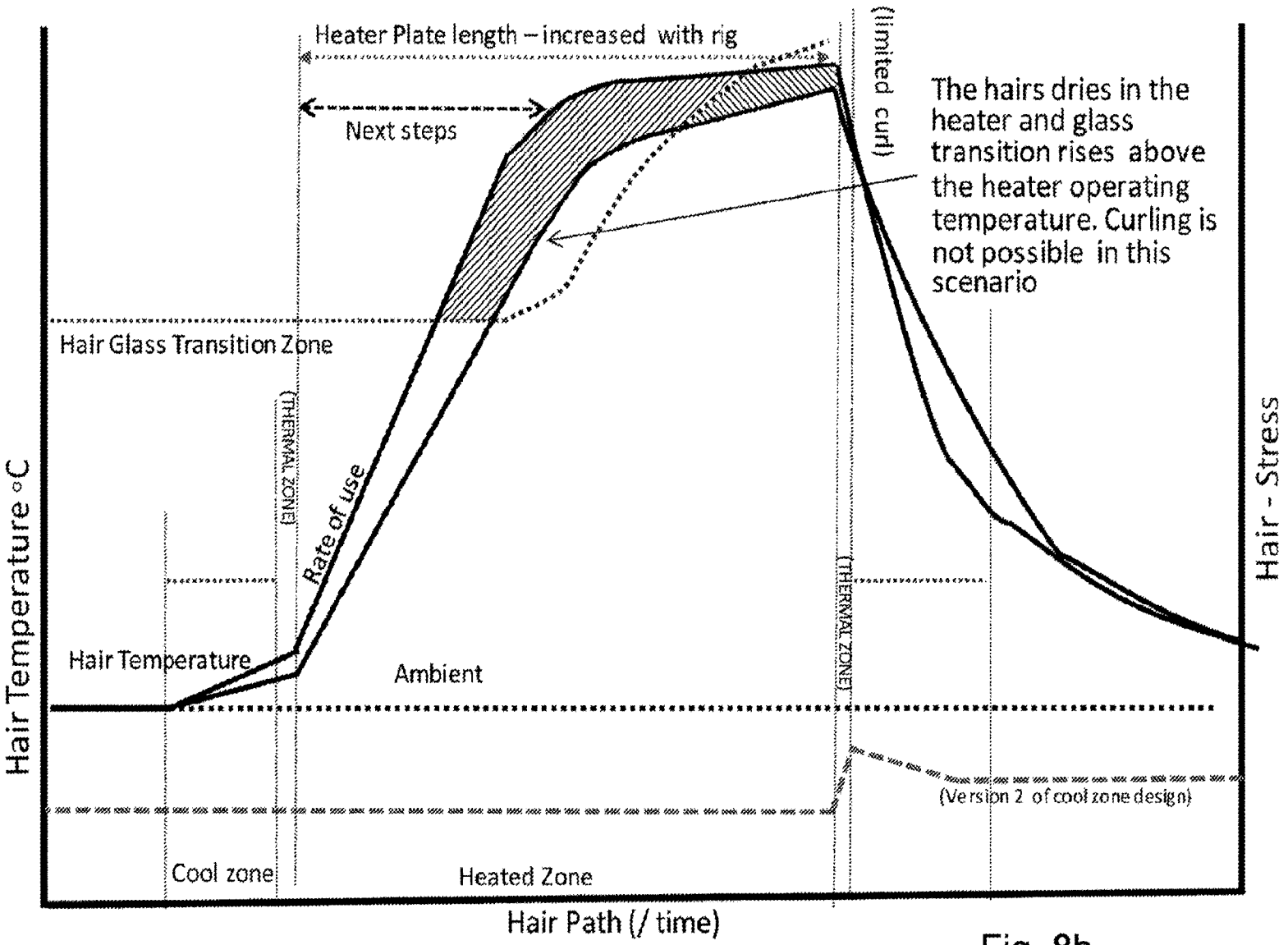
FIG. 8*b* is a chart illustrating variation in temperature and stress for hair being styled using the prior art hair styler of FIG. 1.

The two plot lines in FIG. 8*b* are generally representative of embodiments of the prior art styling apparatus, e.g. as shown in FIG. 1. FIG. 8*b* is broadly representative of what happens if the heated path length is too long. As explained in more detail below, Tg rises meaning the hair does not curl which imbalances the efficiency of the system, placing more demand in heating, stress and cooling power. As an example, this will happen for heater path lengths of approximately 70 mm or greater having a temperature of 185 degrees C. However, with a 40 mm heater path at 185 degrees C. the curling performance is still poor. By contrast, FIG. 8*a* represents a total heater path length of approximately 20 mm at 185 degrees C. which is a reasonable balance of all the conflicting requirements.

FIG. 8*b* shows that at a first, slower rate of use the hair temperature rises quickly in the heating zone and then plateaus. Similarly, at a second, slower rate of use, the hair temperature rises less quickly and peaks just before the hair enters the thermal zone. At both rates, the hair glass transition temperature rises as the hair heats up and in both scenarios, the glass transition temperature is higher than the temperature to which the hair is ultimately heated. Accordingly, the hair is not above the glass transition temperature as it passes into the stress point at the heater outlet and across the thermal zone and thus the hair cannot be curled. Moreover, the hair is heated for too long and begins to dry out which will also prevent curling.

Thus, in summary, the preferred process is to heat hair to above its glass temperature, i.e. above $T_{g1}$; commence bending and curling of the hair when hair is at its hottest temperature and still within the heating zone (or insulating/thermal zone); followed by cooling about a continuing curved surface of the cooling zone in order to retain the curl shape. The stress imparted at the hair also needs to be at a maximum just as the hair exits the heating zone and passes into the cooling zone.

As set out above, the hair styler is easy to use with hair simply being placed between the two arms. However, the hair which is inserted first into the hair styler, typically the hair near the root, is generally exposed to heat for longer than the rest of the hair. For example, this may be caused by the user pausing for a moment after clamping the hair or simply because of the time it takes to close the arms. As a result, the hair which is initially placed in the hair styler is raised to a higher temperature and may even be raised to a temperature which is too high for styling hair.

One solution to this problem may be to change the heater path length, i.e. the time which the hair is in contact with the heating zones. One solution to this problem may be to change the heater path length, i.e. the time which the hair is in contact with the heating zones. As explained with reference to FIGS. 17*a* and 17*b*, the heater path length can be optimised. However, there are limits imposed on the heater path length by compliance requirements for creepage and clearances for electrical connections. Accordingly, it can be challenging and difficult to fine tune the heater path length. Moreover, different path rates are optimal for different rates, e.g. a path length of 16 mm on an aluminium heater may be optimal for a 20 mm/s rate and a path length of 18 mm for a 30 mm/s rate. An alternative solution is to reduce the temperature within the heating zone when the hair styler is not being used to curl hair. For example, the temperature may be reduced from say 185 degrees C. (which is the typical styling temperature) to between 140 to 180 degrees C. A schematic illustration of a circuit to achieve this solution is shown in FIG. 9.

Figure 9A:
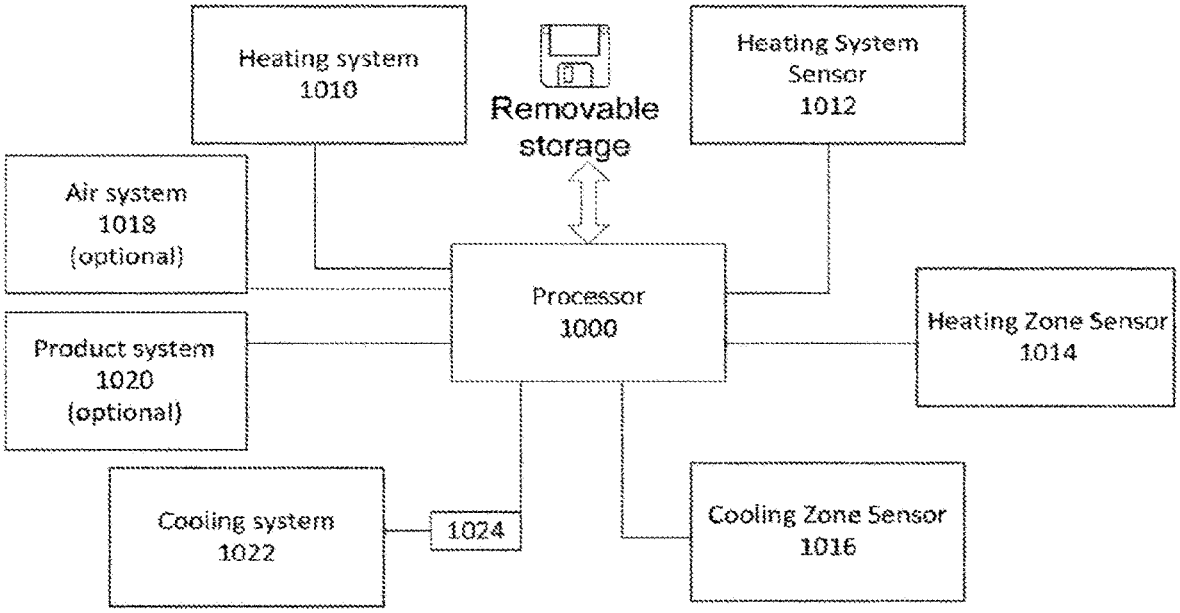
FIG. 9*a* is a schematic block diagram showing the components within the hair styler.
Figure 16A:
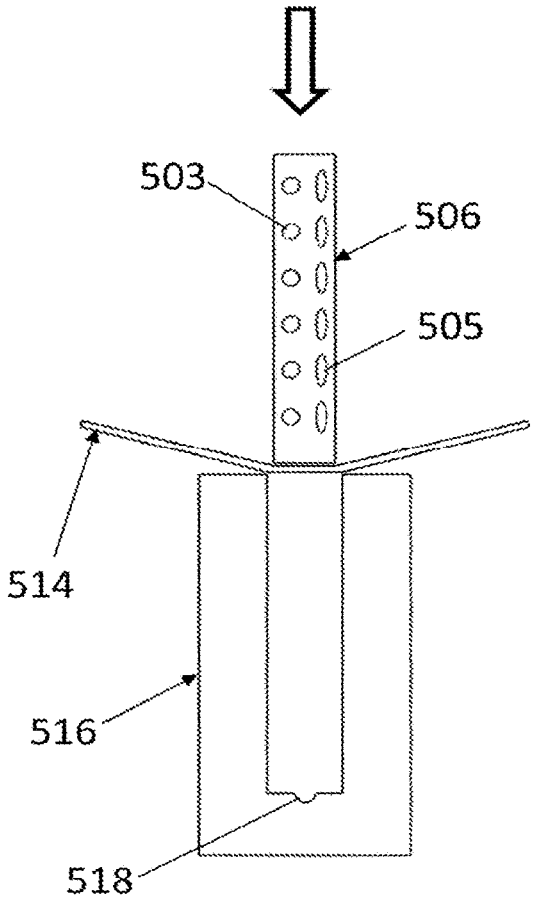
FIGS. 16*a* and 16*b* illustrate the manufacturing process for a heater in the heater assembly of FIG. 15.
Figure 18A:
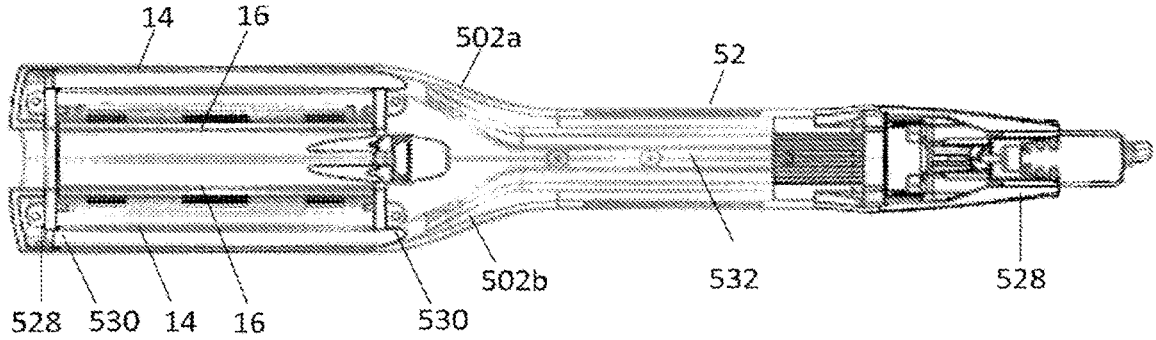
FIGS. 18*a* and 18*b* are schematic cross-sectional views of the styler of FIG. 13.

FIG. 9*a* shows a processor 1000 (e.g. a microprocessor) which controls the heating system 1010 which provides the power to the heaters in the heating zones. Several sensors (heating system sensor 1012, heating zone sensor 1014 and cooling zone sensor 1016) are connected to and provide sensor data to the processor 1000. These sensors are located in the respective component within the styler and a sensor may be embedded in the processor. For example as shown in the arrangement of FIG. 18*a*, the heat pipes are adjacent the PCB and thus a sensor could be embedded on the PCB to sensor the temperature within the heat pipes. For example, the heating zone sensor 1014 may be a sensor 503 as shown in FIG. 16*a* or may be a thermocouple embedded in the heating plate. It will be appreciated that a single sensor is merely indicative and a plurality of sensors may be used where needed. There are also some optional systems, a high pressure air system 1018 for delivering high pressure air and a product system 1020 for delivering products such as wet line products. The cooling system 1022 may be active, e.g. a fan, and may thus be controlled by the processor in a similar manner to the heating system. An automatic or non-self-resetting thermal cut-out 1024 is placed between the processor and the cooling system which is described in more detail in relation to FIG. 9*d*.

Figure 9B:
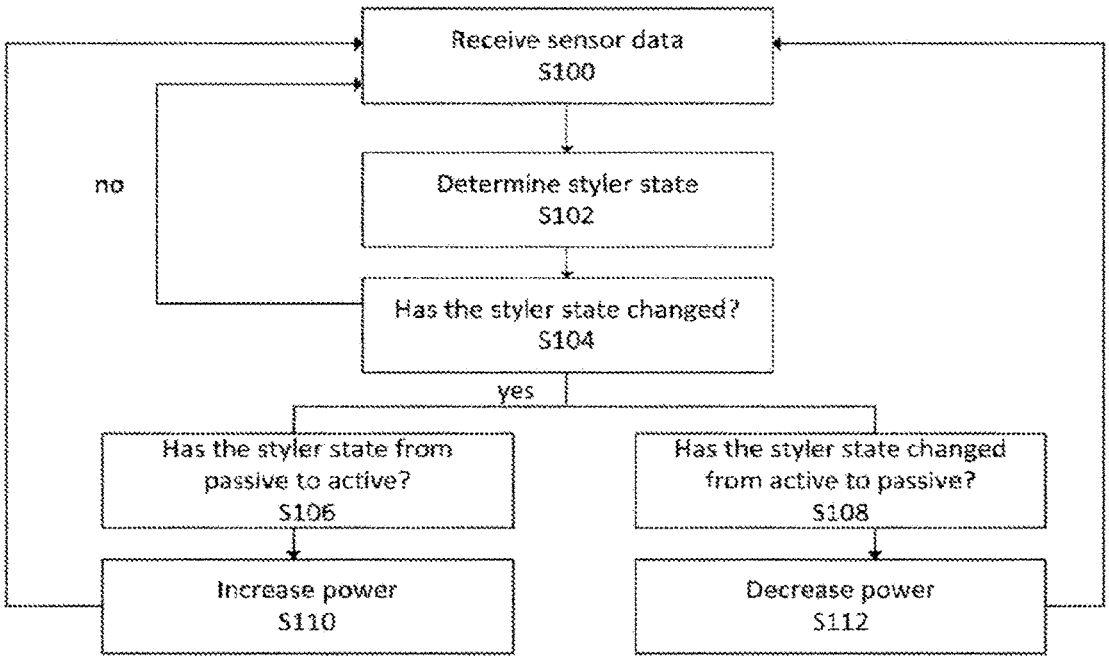
FIG. 9*b* is a flowchart showing the steps in a first method for controlling the heating system of the hair styler.

As shown in the flowchart of FIG. 9*b*, the processor 1000 is configured to control the heating system 1010 based on the received sensor data (Step S100). The processor processes the sensor data to determine when the styler switches between an active state in which a user is curling hair and a passive state in which a user is getting ready to use the styler and vice versa. As illustrated, one method for doing this is to determine what state the styler is in (Step S102) and then to determine whether or not the state has changed (Step S104). If there is no change, the process loops back to the start. When the processor detects that the styler has switched from the passive state to the active state (Step S106), the processor is configured to increase the power to the heating system to increase the temperature within the heating zones (e.g. to 185 degrees C.) (Step S110). When the processor detects that the styler has switched from the active state to the passive state (Step S106), the processor is configured to reduce the power to the heating system to reduce the temperature within the heating zones (e.g. to between 140-180 degrees C.) (Step S112). After any power changes, the process loops back to the start, for example every 1 to 5 seconds or more quickly if needed.

For example, the processor may be configured to determine that the styler is in the active state by one or more of the following methods:

a) the heating zone sensor 1014 measures the temperature within the heating zone and the processor determines that the temperature has dropped between subsequent sensor measurements;

b) the cooling zone sensor 1016 measures the temperature within the cooling zone and the processor determines that the temperature has risen between subsequent sensor measurements;

c) the heating system sensor 1012 measures the current and/or power consumption within the heating system and the processor determines that the current/power consumption has increased between subsequent sensor measurements;

Other mechanisms may also be used to provide the processor with the information to determine the state of the styler, e.g. a micro switch which may detect contact between the arms, a light dependent resistor which is placing in an area which receives no light when the arms are in the closed position or a vibration sensor to detect an impact as the arms are closed.

By reducing power consumption to the heating system when the styler is not being used, the thermal efficiency of the cooling system is also improved because less waste heat energy passes through the thermal zone. Furthermore, the risk of the hair which is initially placed in the hair styler rising to a temperature above $T_{g2}$ is reduced. Another advantage is that the embodied water within the hair is retained. As explained in more detail below in relation to FIG. 16*a*, there is a minimum threshold of moisture content which is required if the hair is to be stressed and then cooled (generating a curl) and if the hair is heated for too long, the moisture content will reduce below this minimum threshold (reducing the efficiency of the curling process).

Figure 9C:
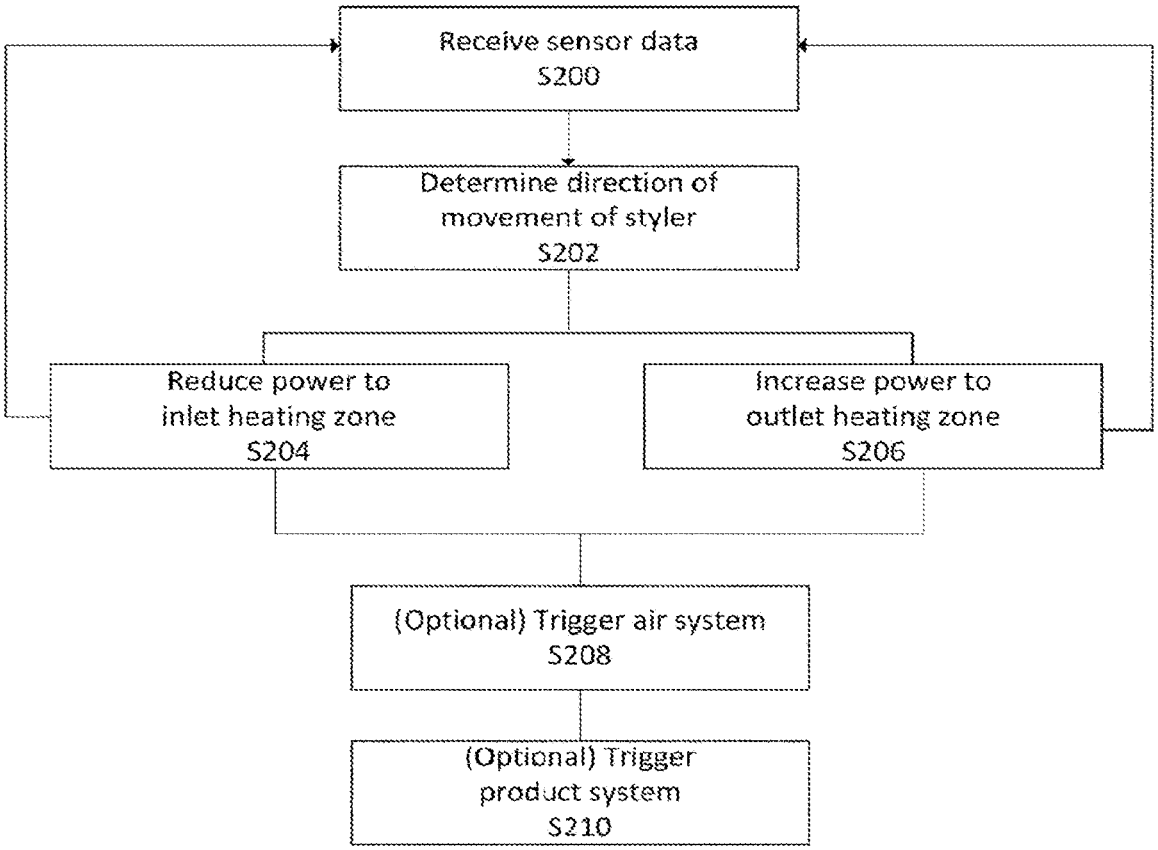
FIG. 9*c* is a flowchart showing the steps in a second method for controlling the heating system of the hair styler.

FIG. 9*c* is another flowchart illustrating how the circuit of FIG. 9*a* can be used to further improve water retention within the hair. This is only suitable with the ambidextrous systems in which there are two heating and cooling zones. The processor 1000 is configured to control the heating system 1010 based on the received sensor data (Step S200). The processor processes the sensor data to determine the direction of movement of the styler (Step S202). Once the direction of movement is determined, the processor reduces the power to the heating zone on the inlet side (S204), i.e. the processor reduces the power to the first heating zone through which the hair passes. Simultaneously, the processor increases the power to the heating zone on the outlet side (S206), i.e. the processor increases the power to the second heating zone through which the hair passes. There may not be separate increases and decreases in power but the processor ensures that the temperature in the second heating zone (outlet side) is higher than that in the first heating zone (inlet side). Once the changes are made, the process loops back to the beginning in case on the next pass, the user alters the direction of the styler.

The processor may be configured to determine that the direction of movement by one or more of the following methods:

a) the heating zone sensor 1014 measures the temperature within each heating zone and the processor determines that there is a differential temperature drop between sensor measurements, e.g. the temperature in the first heating zone has dropped more than that in the second heating zone. This is because the first heating zone through which the hair has passed will have worked harder to heat the hair.

b) the cooling zone sensor 1016 measures the temperature within each cooling zone and the processor determines that there is a differential temperature rise between sensor measurements, e.g. the temperature in the second cooling zone has risen more than that in the first cooling zone. This is because the second cooling zone through which the hair has passed will have worked harder to cool the heated hair.

c) the heating system sensor 1012 measures the current and/or power consumption within the heating systems for each heating zone and the processor determines that there is a differential increase between subsequent sensor measurements for the different heating zones, e.g. the power has changed more in the heating system for the first heating zone. Again, this is because the first heating zone through which the hair has passed will have worked harder to heat the hair.

By reducing the temperature in the first heating zone (inlet side) relative to that in the second heating zone (outlet side), the time that the hair is exposed to high temperatures is reduced and thus the level of embodied water is preserved. The adjustments can be fine-tuned to optimise the curling performance. If the styler had more than two heating zones, the processor may ensure that the heating zones progressively increase in temperature from inlet to outlet side.

FIG. 9*c* also shows a couple of optional steps. For example, at Step S208, the processor is configured to trigger a high pressure air system to deliver air to the most efficient position which may be the inlet or outlet side. Alternatively or additionally, at Step S210, the processor is configured to trigger a product system to deliver a complementary product, e.g. a wet line product, to the most efficient position which may be the inlet or outlet side.

Figure 9D:
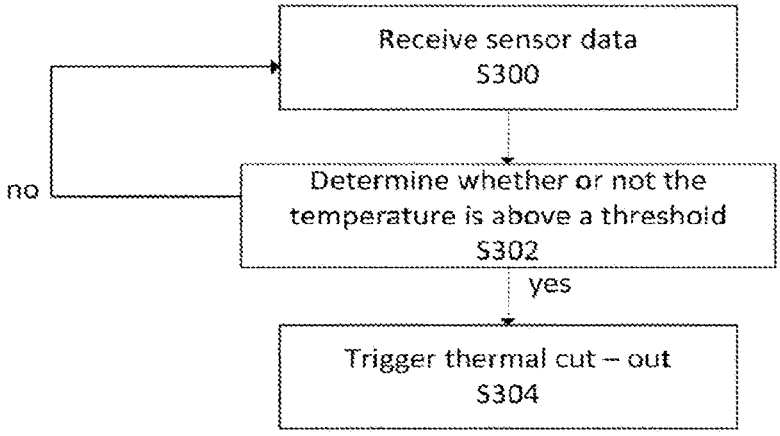
FIG. 9*d* is a flowchart showing the steps in a first method for controlling the cooling system of the hair styler.
Figure 10A:
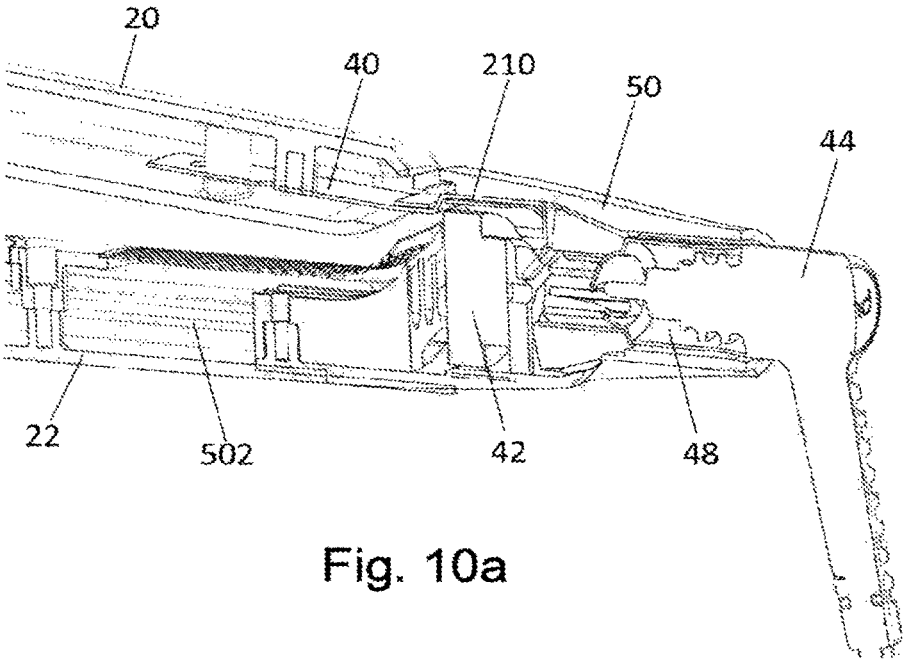
FIG. 10*a* is a cross-section of one end of the hair styler according to the present invention.
Figure 10B:
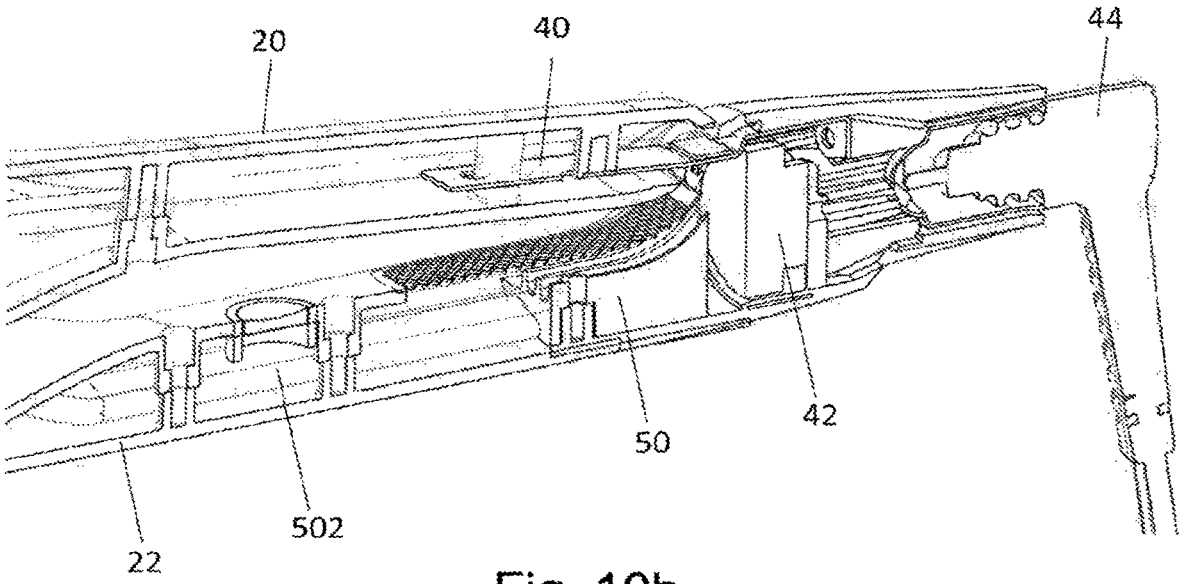
FIG. 10*b* is a perspective cross-section of the end shown in FIG. 10*a;*
Figure 11A:
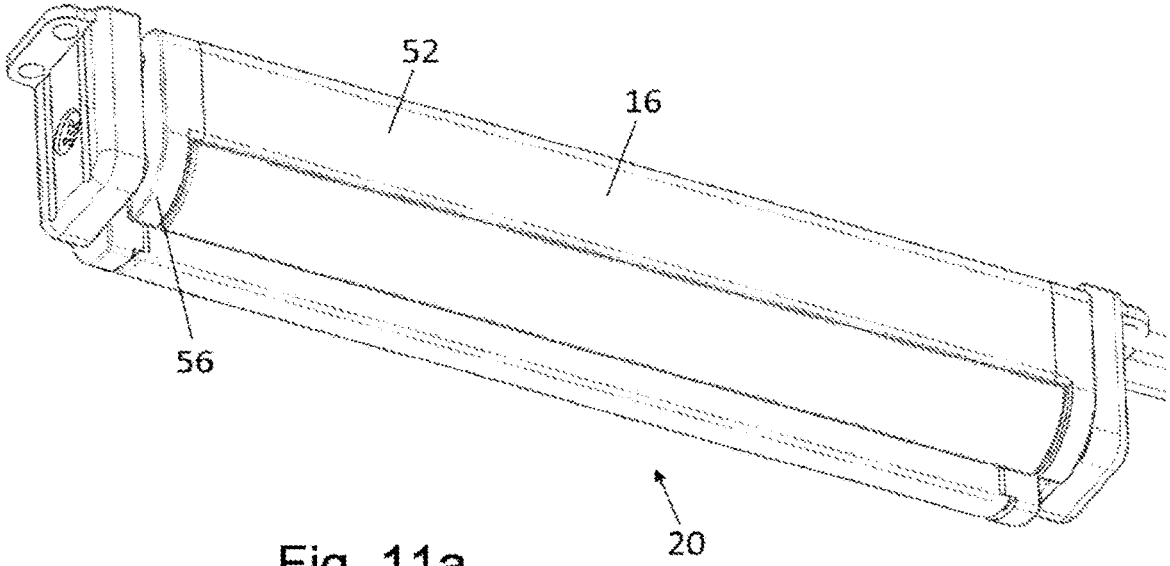
FIG. 11*a* is a perspective view of the first arm of the hair styler according to the present invention.
Figure 11B:
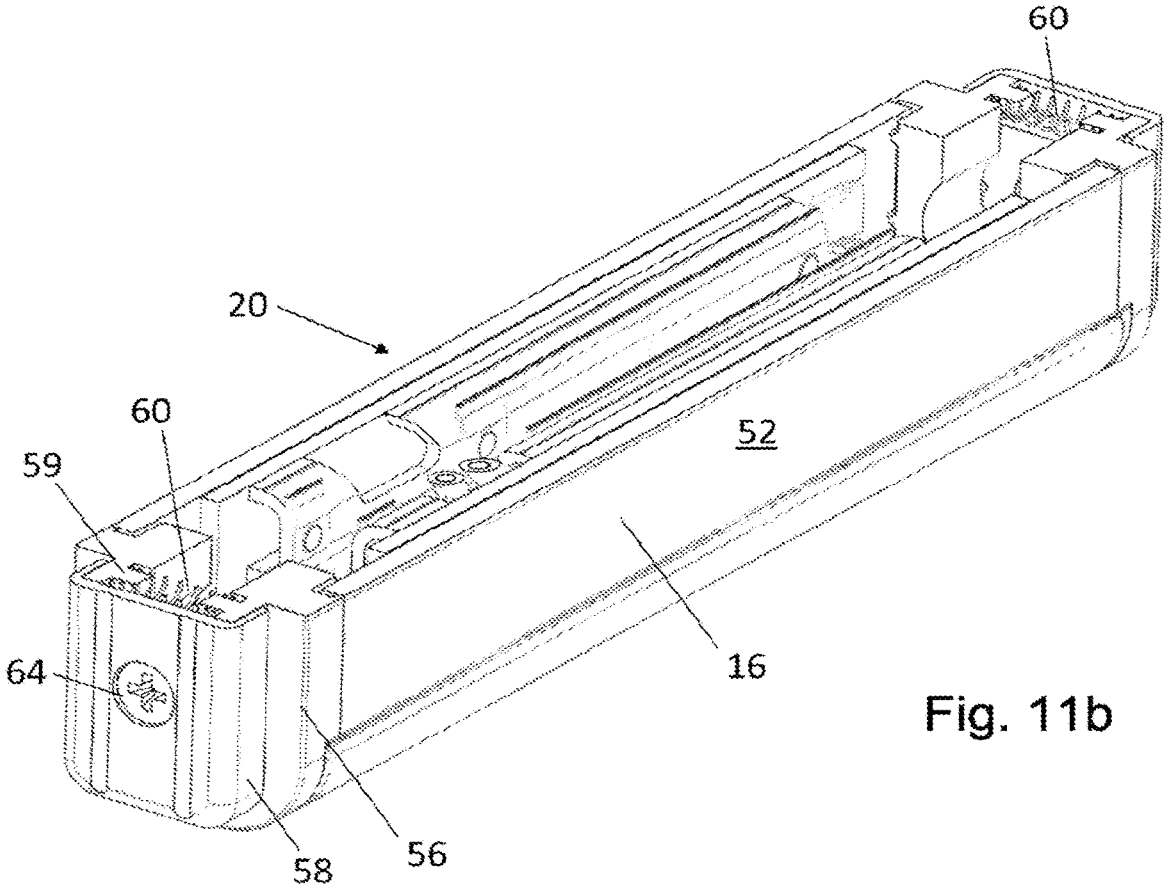
FIG. 11*b* is a perspective view of the arm of FIG. 11*a* with the top portion of the arm removed to show internal components.

As shown in FIG. 9*d*, the processor may also be configured to isolate the styler if the temperature of the styler is too high. If the cooling system or the thermal insulation fail in the styler, the temperature of the styler may rise above safe limits. For example, the styler may be too hot to hold or the processor (PCBA) itself may be raised above the safe operating temperature. This may be prevented as shown in FIG. 9*d*. The processor is configured to receive the sensor data S300 and process it to determine whether or the temperature is above a threshold S302. The threshold is a limit between 70 to 100 degrees C., more preferably between 80 to 85 degrees C. Thus the threshold is lower than the safety limit. If the temperature is OK, the process loops back to the start. Otherwise, the thermal cut-out 1024 is activated. This isolates the power to the heating system. The processor may be configured to determine the temperature by one or more of the following:

a) Receiving sensor data on the temperature of the cooling system b) Receiving sensor data on the current in the fan and determining the temperature therefrom c) Receiving sensor data on the RPM of the fan and determining the temperature therefrom FIGS. 10*a* and 10*b* show one arrangement by which the two arms may be joined together. The arrangement may be termed a shoulder 50. The styler may be held by a user around the shoulder and/or around the arms 20, 22. Thus, the arms and/or shoulder may be considered to be a handle. The shoulder of FIGS. 10 and 11 incorporates a leaf spring 40. As shown, the leaf spring extends from the shoulder into the first arm 20 (although it will be appreciated that it could extend into the second arm 22). The leaf spring 40 biases the first arm 20 away from the second arm 22. Thus, the leaf spring 40 biases the arms in the open position. A user has to exert force against the leaf spring 40 to close the arms.

The leaf spring 40 is connected to the heat sink 210 in the shoulder 50. This means that the leaf spring 40 also assists in drawing heat away from the first arm and into the heat sink 210. This reduces the need for a separate heat sink in the first arm and thus results in a smaller styler having reduced material mass and reduced manufacturing cost.

The spring force of the leaf spring must be such that it biases the arms in the open position. Moreover, the force must be balanced between being too high so that a user cannot close the arms and too low so that the user can close the arms too easily. The spring force must also be greater than any frictional forces on the hair to avoid the styler jamming shut on a section of hair. Accordingly, the spring force of the leaf spring needs to balance these different requirements. A suitable range of spring force is between 1 and 5 newtons, with a spring force of 1 to 2 newtons giving an acceptable result.

FIGS. 10*a* and 10*b* also show that a fan assembly 42 may be optionally incorporated in the shoulder 50. The fan assembly 42 provides an active cooling system for the cooling zones at the opposed end of the arms. The fan is used to circulate an appropriate forced air convection cooling through the rear heat sink which in turn cools the entire cooling system. The fan's air flow V's pressure performance typically could be ~60 Pa at its stall point and a minimum of 0.1 $m^3$/min at "free air" or 0 Pa. Typically the operating duty point of the fan could be 10 pa @ 0.95 $m^3$/min. There is at least one inlet 50 for the fan assembly through the housing of the arms. In this arrangement, the inlet 50 is in the form of a meshed grid having a plurality of apertures through which air may pass. The apertures are small enough to prevent too much debris being drawn in to the system. Moreover, the inlet 50 is on an inner surface of the second arm 22. Thus, the user is unlikely to contact and thus block the inlet 50. There is also an outlet 48 for the fan assembly which vents out of the styler through the housing of the shoulder. The outlet 48 is around the electrical connector 44 for the power cable. There may also be an additional outlet 43 which vents through the housing of the styler, e.g. through the side wall of the shoulder 40.

There is also a passive cooling system for the cooling zones provided by at least one heat pipe 502 which connects to a second heat sink 501. Although the cooling system is termed passive; both the passive and active cooling systems positively (or actively) draw heat away from the cooling zones to improve performance. In other words, the apparatus contains cooling means to ensure that the cooling zones are reduced in temperature without merely relying on ambient cooling. Indeed, cooling the hair over a conductive surface alone has been shown to be insufficient. During use, the cooling zones will increase in temperature and without a thermal management system (otherwise termed a cooling system) to reduce the temperature in the cooling zones, the temperature in the cooling zone rises above 100 degrees C. which is too hot to provide the curling. If the cooling zones are not actively cooled, it would be necessary to wait for a large amount of time between curling each section of hair to allow each cooling zone in the system to cool to a viable temperature for curling hair.

The heat sink 501 comprises a plurality of fins to increase the surface area and thus improve cooling. The surface area may be a minimum of 6790 $mm^2$. There may be multiple heat pipes, e.g. two, for example as described in more detail below. Each heat pipe may be connected to its own separate heat sink. The second heat sink 501 may be thermally connected to the heat sink 210 which is integrated with the fan to improve cooling performance. The fan assembly may also be embedded into the heat sink 210. Heat pipes are typically a more effective method of cooling than an aluminium heat bridge or the use of pumped fluids. As an example, the cooling power required from a thermal management system:

| Speed (mm/s) | Power to prevent cooling plate temp rise (W) | Minimum power (W) |
|---|---|---|
| 10 | 9.3 | 6.0 |
| 15 | 13.0 | 5.6 |
| 20 | 16.3 | 5.3 |
| 25 | 19.1 | 5.0 |
| 30 | 21.5 | 4.6 |
| 35 | 23.5 | 4.4 |
| 40 | 25.1 | 4.1 |
| 45 | 26.5 | 3.8 |
| 50 | 27.6 | 3.6 |
| 55 | 28.4 | 3.4 |
| 60 | 29.1 | 3.1 |

Each heat sink has a maximised thermal mass and thermal conductivity, e.g. ideally at least 150 W/mk. The heat sink may be made from an aluminium alloy. The heat sink must also have a maximised emissivity, for example by using a black surface which may be matt. The overall mass of the heat sinks may be maximised to accommodate spikes in thermal transfer during use. For example, a minimum of 45 g may be necessary. However, this is a hand-held product and thus too great a mass would be detrimental to user experience. It may also be beneficial for the user experience to balance the mass of the two arms. The heat sink in the handle should not cause the handle to become too warm for the user. This can be avoided by appropriate positioning of the heat sink and also by ensuring that there are not bare metal surfaces on the handle.

As explained above, the best results are achieved when the contacting surfaces are planar and are substantially parallel to one another. Furthermore, the contacting surfaces of the heating zones 16, 16' on the first and second arms need to have a good contact with the hair to ensure efficient heating. Up to a certain threshold, the greater the pressure on the hair, the more efficient the styler is at styling the hair. However, if the pressure is too high and is beyond the threshold, there is too much friction between the heating plates and the hair. This means that the product is difficult and unpleasant to use. FIGS. 11*a* to 12*b* illustrate one mechanism for achieving parallel contacting surfaces with a desired pressure on the hair. The mechanism operates regardless of the orientation of the device (e.g. curling/straightening orientation). In this arrangement, each heating zone 16 of the first arm 20 comprises a heater plate which is mounted on a resilient suspension as described in more detail below. The resilient suspension allows relatively small movement of the heater plate which improves the pressure on the hair between the heating zones of the two arms and thus the heat transfer to the hair. Depending on whether the styler is in the curling or straightening orientation, the resilient suspension may also improve the stress imparted on the hair at the heater outlet. The resilient suspension is designed to balance the conflicting requirements of too much friction and good heat transfer. A suitable level of force applied to the hair by the resilient suspension is 1.8 N because this has no/low frictional forces on the hair. The force may be up to 3.9 N but beyond this the friction (stiction) is too high). In either case is critical to specify a resilient suspension, e.g. a spring, with a low as possible rate, so that force applied to the hair between the heater plates is as uniform and as independent as possible from the thickness of the hair section that is between the contacting surfaces.

By contrast, each heating zone of the second arm also comprises a heater plate but these are fixed relative to the housing of the second arm. In both arms, rotation of the heaters may be prevented by mounting the heaters in a rigid frame within which the heaters can slide or 'float' slightly to absorb mechanical tolerances.

Even though the resilient suspension allows only relatively small movements, there is the possibility that the contacting surface 52 of the heating zone 16 may not be aligned with the contacting surface of the corresponding heating zone 16' on the second arm. Accordingly, as shown in more detail in FIGS. 11*b* to 12*c*, the resilient suspension is formed as a biasing mechanism to ensure that the contacting surfaces 52 are held parallel to those of the second arm. The heater plates (and other internal components of the first arm which are not shown) are supported in a housing 56. In this arrangement, the biasing mechanism comprises four springs 60, one at each corner of the heater plates. The housing 56 comprises a plurality of projections 59 and one projection 59 is received in each end of each spring 60. In this way, each spring is connected at one end to the heater plate in the first heating zone and at the other end to the heater plate in the second heating zone. A pair of end caps 58 are connected one at each end of the housing 56 by a fixing mechanism 64, which may be any standard mechanism, e.g. screw.

Figure 12A:
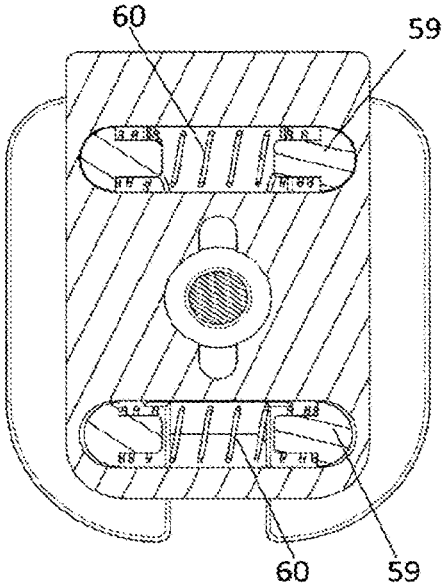
FIG. 12*a* is a cross-section through an end cap of the housing of the arm of FIG. 11*a;*
Figure 12B:
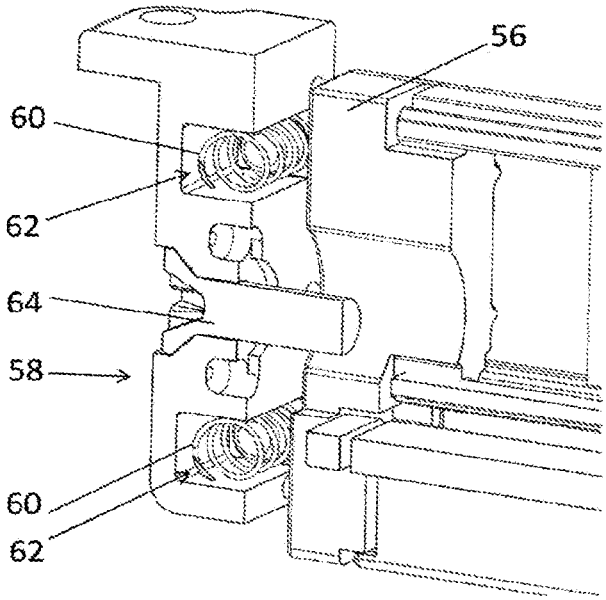
FIG. 12*b* is a cross-section of the end cap and end of the housing of FIG. 11*a;*

As shown in FIGS. 12*a* and 12*b*, each end cap 58 comprises a pair of recesses 62 each of which receive a corresponding spring 60. The recesses 62 control the movement of the springs 60 by constraining the movement of the springs to be perpendicular to the contacting surface. Hence the movement of the contacting surfaces is controlled and maintained parallel to the contacting surfaces on the second arm. It will be appreciated that in this arrangement the biasing mechanism is only shown in the first arm but that it could alternatively or additionally be incorporated into the second arm and the heater plates of the first arm could be held fixed.

Figure 13:
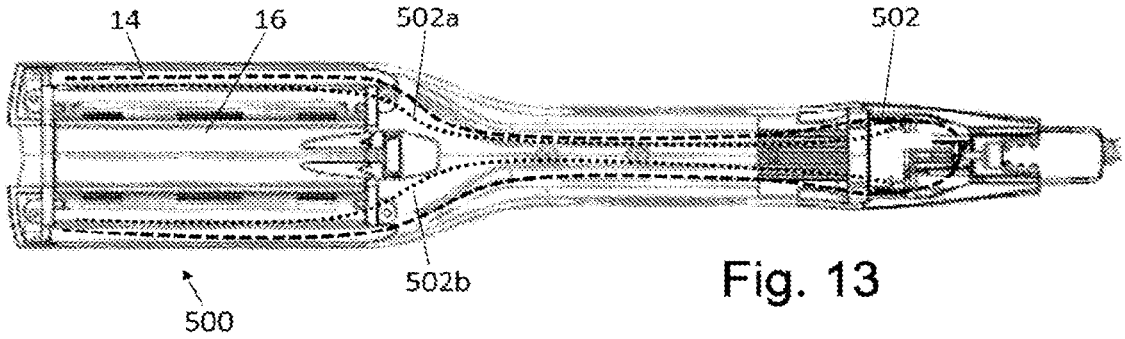
FIG. 13 is a schematic planar cross-section through another variant of the styler.

FIG. 13 is a schematic cross-section of an embodiment of the hair styling apparatus 500, showing the heat pipes 502, 502*a*, 502*b* which may be used to cool the cooling zones. Heat pipe 502 is a continuous pipe which passes through the cooling zone 14 on one side of the apparatus along the handle, passes around a large bend at one end of the handle and extends back along the 5 handle to and through the cooling zone 14 on the other side of the apparatus. Thus, the heat pipe 502 provides a thermal link between the two cooling zones albeit a thermal link which extends along the length of the apparatus rather than merely across the width (e.g. as shown in FIG. 7*a*). Such a continuous heat pipe 502 links both cooling zones and thus maximises transfer of heat between the zones, i.e. allows the 10 cooling zone through which the unheated hair passes before being heated to draw heat from the cooling zone through which the heated hair is passed for cooling and curling. The heat pipe thus minimises the temperature difference across the system.

It is essential to have a continuous pipe and this necessitates bends in the pipe, particularly at the opposed end of the apparatus to the heating/cooling zones. However, any bend results in significant losses and thus a heat pipe having a large diameter (e.g. 6 mm or more) is required to transfer sufficient heat. A large pipe is costly, may result in increased production times and may also increase the overall size of the apparatus.

FIG. 13 also shows an alternative arrangement in which the single heat pipe 502 is replaced with two separate heat pipes 502*a*, 502*b* which each extend through only one of the cooling zones, through the handle to a heat sink at the end of the apparatus. In this way, the large bend is eliminated and thus the two separate pipes are more efficient in transferring heat than the single pipe 502. Accordingly, the diameter of each separate pipe may be relatively small, e.g. 3 to 6 mm and the for the passive cooling of external surface area of the heat pipe and heat sinks should be between 90 $cm^2$ to 350 $cm^2$, preferably around 210 $cm^2$. This is a relatively high surface area which is difficult to achieve in a hand held product because of the size, weight and cost. Accordingly, the heat pipes are typically used in conjunction with active fan cooling to achieve the necessary active cooling. A smaller diameter may result in a more cost effective design because less material is required to manufacture the heat pipe. Furthermore, if the diameter of the heat pipe is reduced, the size of the thermal zone may be increased without any overall increase in the size of the apparatus (therefore reducing the cooling requirements of the heat sink). Accordingly, thermal efficiency and control of temperature increases in the cooling zone may also be improved further. However, it will be appreciated that the separate pipes slow the rate of heat transfer from one cooling zone to the other. This is because the heat from one cooling zone is transferred via the heat pipe through the heat sink and back into the other heat pipe to the other cooling zone. The heat sinks should typically be a few degrees cooler than the cooling zones. However, the temperature differential across the heat pipes should only be a couple of degrees when operating correctly. If the thermal power the heat pipes are transferring becomes too high, the heat pipe may dry out, causing excessive temperature differences along the length of the heat pipe (resulting in poor heat transfer). This may be avoided by increasing the mass of the heat sink or the diameter of the heat pipes to facilitate greater heat transfer. However, as set out above, this needs to be balanced against cost, weight and size constraints in the device. The heat pipes may be coated with a low friction and/or corrosion resistant material.

FIGS. 14 to 17*a* show another variant of the apparatus of FIG. 2*a* in which the heating zone is angled relative to the direction of opening and closing the arms. Features in common are labelled with the same reference number where possible. The general concept is similar and the skilled person will recognise that many features may be used on both the embodiments. Thus as in the embodiment of FIGS. 2*a* to 6, the heating apparatus comprises a first arm having a pair of heating zones 16 and a second arm having a pair of heating zones 16' which are in contact with the heating zones 16 on the first arm. The contacting surfaces of the heating zones 16, 16' are aligned so that they are generally parallel to the direction of opening and closing the first and second arms. This is achieved by the second arm having a groove running along at least part of its length and the first arm having a profile which is a snug fit within the groove so that the first arm and second arm have complementary profiles to ensure contacting surfaces along at least part of their length. When the arms are in the open position, hair is placed between the two arms and the arms are closed so that the first arm is received within the second arm which at least partially surrounds the first arm. Hair 10 is thus clamped between the first and second arms.

Figure 14:
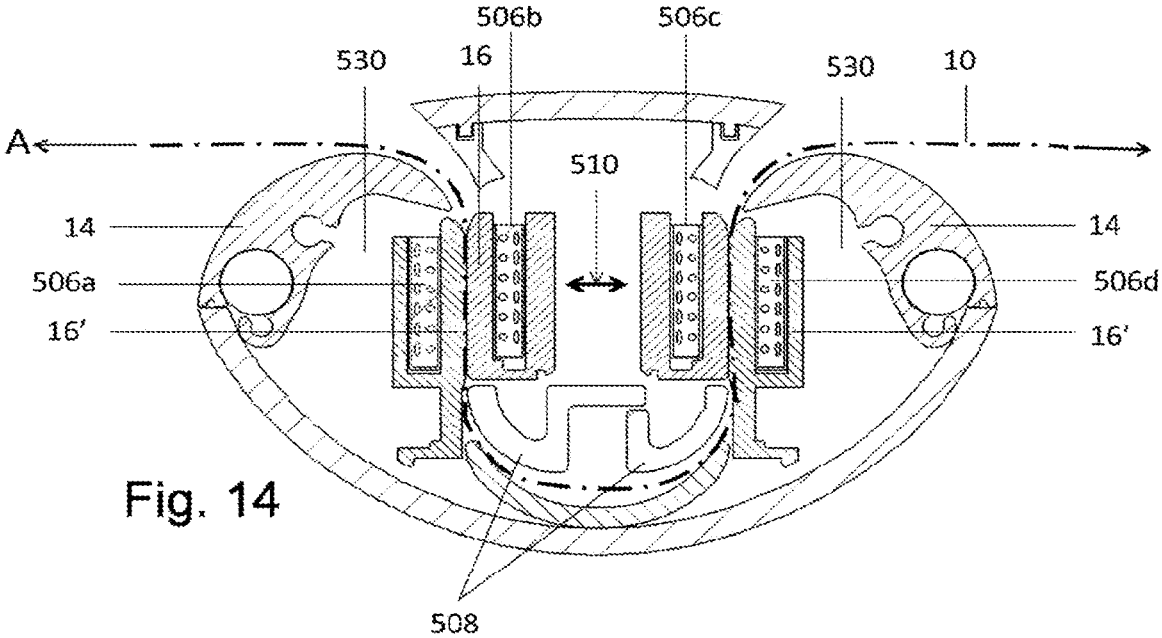
FIG. 14 is a cross-section through another variant of the styler.

FIG. 14 shows that the apparatus comprises four heaters 506*a*, 506*b*, 506*c* and 506*d*. Two of the four heaters 506*b* and 506*c* are on the first arm and the other two heaters 506*a*, 506*d* are on the second arm. The use of four heaters maximises the amount of heat imparted to the hair and also ensures that the apparatus may be used in either direction. It would be possible to omit the heaters on the first arm (relying on the heaters on the second arm) or vice versa. Such an arrangement would still enable the device to be used in either direction. However, the hair would only be heated on one surface which is not efficient as explained in more detail below. Alternatively, the contacting heaters 506*a* and 506*b* (or 506*c* and 506*d*) may be removed. However, this would mean that the hair could only be curled by passing through the apparatus in the direction of arrow A.

There are thermal zones 530 between the heating zones 16' and cooling zones 14 on the second arm. There is also a heat pipe in the cooling zone which may be a continuous pipe or two separate pipes as described in relation to FIG. 13. A pair of insulators 508 ensures that the heat transfer to the hair from the heaters in minimized.

The pair of heaters 506*b* and 506*c* on the first arm are preferably mounted for movement relative to each other. This ensures that the surface of each heater 506*b*, 506*c* is always in firm, good contact with the contacting surface on the other arm (which in this case is also the surface of the heaters 506*a*, 506*d* respectively) when the arms are in the closed position but also allows for the arms to move relatively easily between the open and closed position. As explained previously, the hair has to be held between two surfaces in the heating zone, particularly at its outlet (which may be curved as explained above) to impart the necessary stress to the hair when the hair is above its glass transition temperature. This generates the curl that is retained by the cooling zone. It is also desirable to maximise the time that the hair has to cool on the cooling zone.

Both these requirements mean that there could be a small draft angle of between 0 and 10 degrees. Draft is typically defined as the amount of taper perpendicular to the parting line. In this case, the draft angle is measured between the direction of opening and closing (i.e. vertical as shown in the drawings) and the plane of the contacting surfaces. Although 10 degrees would be the simplest mechanical system to ensure ease of opening and closing; minimal curling performance would be observed because the hair would not be clamped tightly between the contacting surfaces. An inverted (or reversed) draft angle at the transition from the heating zone to the cooling zone (i.e. at the heater outlet) would provide the best curling performance. However, such an inverted (or reversed) draft angle means that it is difficult to move the two arms between the open and closed position because of the frictional forces between the two close fitting contacting surfaces. Moreover the cost and mechanical complexity would be high. Accordingly, a draft angle of approximately 0 degrees provides the best balance of curling performance and mechanical cost.

Figure 15:
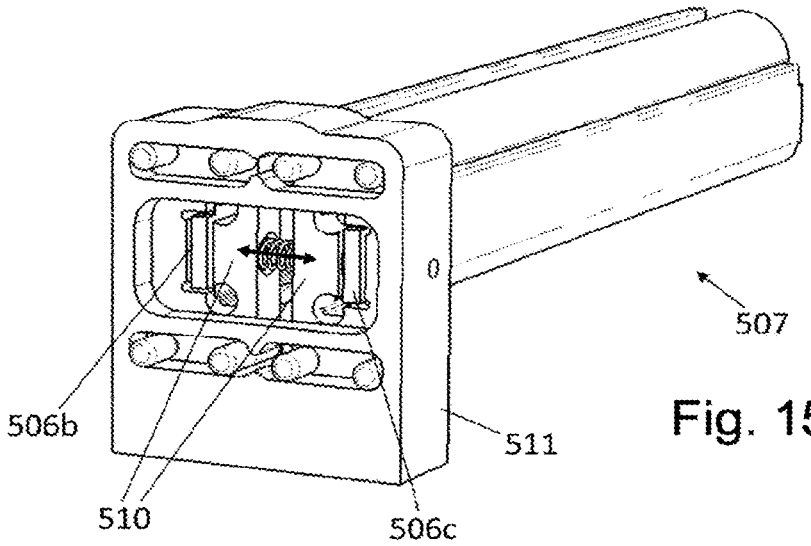
FIG. 15 is a partial perspective view of one heater assembly in the styler of FIG. 14.

FIG. 15 shows one mechanism 507 for achieving this relative movement which comprises mounting each end of each heater 506*b*, 506*c* in a mounting block 510. It is noted that FIG. 15 only shows one end of the heater but the mechanism is repeated at the opposed end. The two mounting blocks are joined by a resilient member (not shown but indicated by the double headed arrow) which allows the mounting blocks to "float" relative to each other. The resilient member may be a spring or other flexible material such as silicone. Each mounting block 510 is housed in a housing 511 and can slide within a groove in the housing 511. The resilient member allows the heaters 506*b*, 506*c* to move inwards stopping the hair from experiencing high friction between the contacting surfaces and/or to allow a user to open the product. The block and housing constrains movement in the correct direction.

Figure 16B:
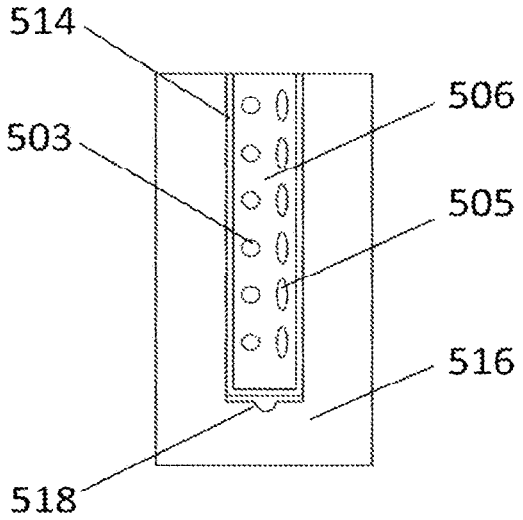

FIGS. 16*a* and 16*b* show one mechanism for simplifying the manufacture of the heating assembly which may be used in any of the embodiments, e.g. FIG. 14. Each heating assembly comprises a housing 516 which has a profile matching that of the heater 506 to be housed within the housing 516. In this case, the profile has a cross-section which is generally a square U but other profiles may be used. The housing has a base from which two side walls extend (generally perpendicular to the base). The base and side walls together define an open cavity. There is no top for the housing leaving an opening into which the heater can be inserted.

The housing may be an extrusion of a thermally conductive material, e.g. aluminium. The housing 516 may also be provided with features to allow for variation in the heater and/or extrusion tolerances in the housing. For example, the profile may comprise a notch 518 or groove running along the length of the base of the housing which acts as a hinge to allow some movement of the sides of the housing relative to each other. Another tolerance improvement which could be used together or separately from the notch is to gradually decrease the thickness of the protruded material from the centre of the base (i.e. from the notch) towards the opening into which the heater is inserted. Such tapering of the material thickness along the length of the material may minimise the risk of work hardening the material (e.g. aluminium) over time.

The heater itself may comprise several layers laminated together. For example, as shown in FIG. 16*a*, the heater may comprise a heating layer having a (one or more heating elements) plurality of heating elements 505 and a sensor layer having a (one or more) plurality of sensors 503. The heater is arranged in the apparatus with the sensor layer between the hair and the heating layer. The sensors may collect sensor data about a user's hair and this sensor data may be used to adjust the heating to prevent or minimise damage to a user's hair. Placing the sensor between the hair (load) and the heating element also allows the apparatus to maximise the thermal response.

The heating assembly may further comprise an optional thermal layer 514 between the heater and the housing to improve thermal conductivity between the heater and the housing. As shown in FIG. 16*a*, this may be in the form of a thermally conductive sheet (e.g. graphite) which surrounds the heater in the housing. Alternatively, a 15 thermal grease may be used in place of the sheet. FIG. 16*a* shows that the thermal sheet is placed over the housing and the heater is pushed into place in the housing to assemble the heating assembly.

All of the features shown in FIG. 16*a*, namely the relative arrangement of the sensor 20 layer and the heating layer, the materials selected for the housing and thermal layer 514, the profile of the housing contribute to a heating assembly which is easy to manufacture and is as small and powerful as possible. It will be appreciated that not all of these features are required to achieve a satisfactory result. It is noted that traditional heaters are assembled in a sandwich principal to allow good and uniform pressure 25 (and good heat transfer to be achieved). However, these typically result in an assembly which is too large for this apparatus.

There is a minimum threshold of moisture content which is required if the hair is to be stressed and then cooled (generating a curl) and if the hair is heated for too long, the moisture content will reduce below this minimum threshold (reducing the efficiency of the curling process). Moreover, as explained above, the hair needs to be at a temperature above the glass transition temperature. Both these requirements can be achieved by heating the hair along a short heater path length, for example along a path of less than 70 mm, preferably approximately 20 mm. However, as explained previously, the apparatus may be pulled along the hair in any direction to achieve curling. As a result, the hair must be heated twice, a first time between one pair of contacting surfaces of the heating zones and again between the other pair of contacting surfaces of the heating zones.

Figure 17A:
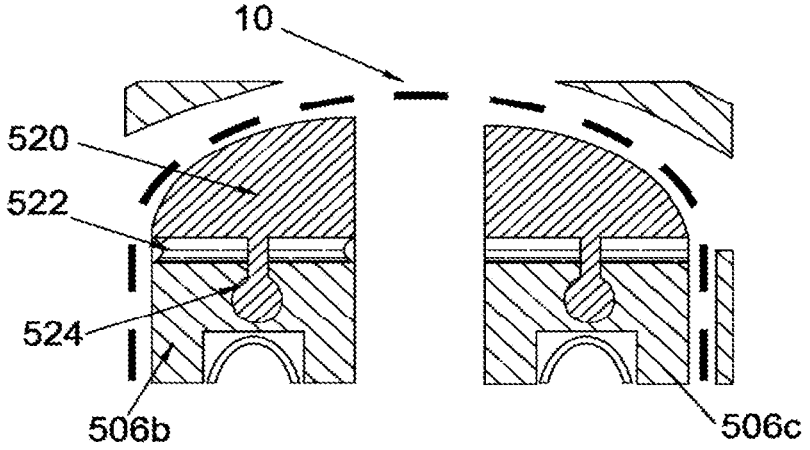
FIG. 17*a* is a close-up of part of the styler of FIG. 14.
Figure 17B:
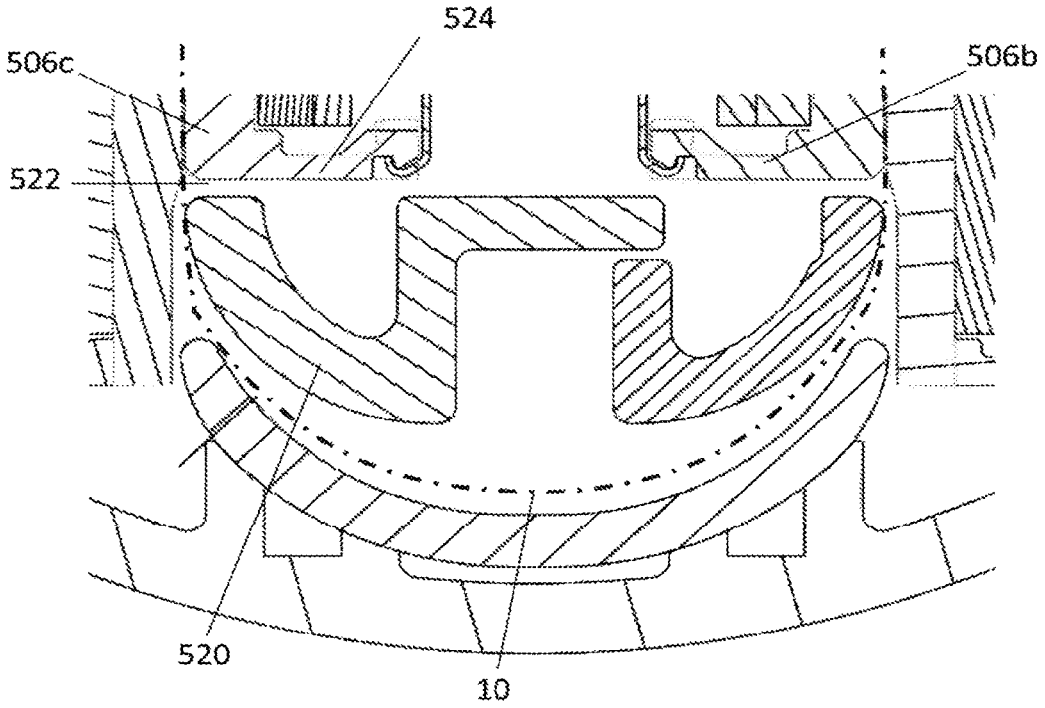
FIGS. 17*b* and 17*c* show the detail of two different parts of the styler of FIG. 2*a;*

FIGS. 17*a* and 17*b* show how the heater path length is reduced in the arrangements of FIGS. 14 and 2*a* respectively by placing an insulated curved section between the two heater paths. The insulated section comprises a pair of insulators 520, one insulator 520 mounted on top of the heater 506*b* in the first heating zone in the first arm and one insulator mounted on top of the heater 502*c* in the second heating zone on the first arm. The insulators 520 are made from any insulating material, e.g. plastics, and have a curved profile along the contacting surface. As shown in FIG. 17*a*, a further layer of insulation 522 (e.g. aerogel) may be provided between the insulator 520 and the heater 506*b*, 506*c* to reduce heat transfer to the insulator 520 and to minimise direct contact between the heater and the insulator. Furthermore, the connector 524 which attaches the insulator to the heater 506*b*, 506*c* may be designed to further reduce heat transfer. For example, the connector may be designed with turns and other complexities to increase the distance heat must travel and/or maximise the heat resistance. Such a connector may be termed a labyrinth connector and may be made from any insulating material such as plastics. As shown in FIG. 17*b*, the insulators 520 are relatively thin so as to define an air gap between the insulator 520 and the heater which prevents heat transmission.

The curved profile reduces conflicting directions of stress to the hair (helping the quality of curl) in contact with this section. Furthermore, when hair is initially placed between the arms and the arms are closed, there is a slight time delay before a user begins to move the apparatus across the hair. Accordingly, hair is in contact with the contacting surfaces for longer than hair which is just pulled through the apparatus. The curved profile also helps to avoid a kink or straight band in the hair which could be caused by this slightly prolonged clamping between the contacting surfaces.

Use of an insulator ensures that the heat transfer to the hair from the heaters is minimised. The aim is to keep the apex (top surface) of the elongate section of the first arm as cool as possible. As explained in relation to FIG. 8*a*, when hair passes relatively slowly through the apparatus, the temperature of the hair drops in this insulated zone but rises slightly when the hair passes through more quickly. At a slower rate, the hair is effectively not heated in this section thereby reducing the heater path length. The hair is then only heated for curling purposes as it passes through the final pair of contacting heating surfaces. Thus, the heater path length is defined by the contacting surfaces of the heaters and the heater power needs to be maximised, e.g. using the heater assembly described in detail in FIGS. 16*a* and 16*b*.

Figure 17C:
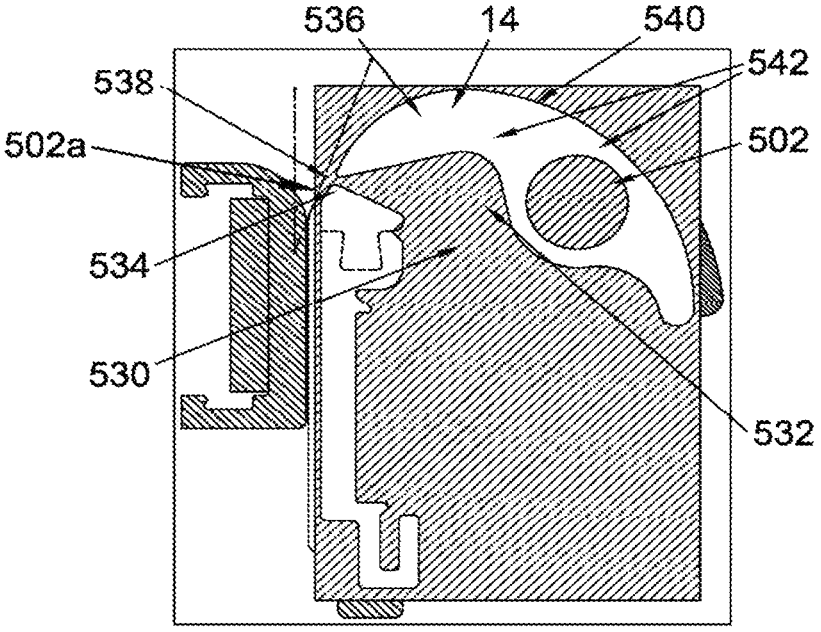

An unwanted straightened band can also be created in the hair (which may be termed bending/banding/kinking of the hair) along the inlet/outlet to the heating zones as the arms are closed. FIG. 17*c* shows one arrangement designed to minimise this unwanted effect. As described above, each heater on the first arm may optionally be fitted with an insulator along the apex of each heater. In FIG. 17*c*, each heater on the second arm is fitted with an insulation section 502*a*, e.g. a plastic tip. The insulation section runs along the edge of the heater which is at the inlet/outlet to the channel, i.e. along the opposed edge to the edge within the channel. As shown in FIG. 17*c*, the heater has a channel into which a corresponding projection on the insulation section fits. It will be appreciated that other known methods of securing the insulation section to the heater may be used.

FIG. 17*c* also illustrates in more detail other features of the cooling zone 14 which are applicable to all embodiments, particularly the one shown in FIG. 2*a*. A tangential line at the point of the first portion 536 of the curved cooling zone, i.e. the portion adjacent the heating zone is at an angle of approximately 25 degrees to the plane of the surface of the heating zone. Moreover, the first portion of cooling zone preferably terminates in a point 538 or at least has a significantly reduced cross-section, e.g. just 0.5 mm, where it is adjacent to the heating zone. This reduces heat transfer. To further reduce heat transfer, there is also a small air gap 534, e.g. 0.5 mm between the closest points on the heating and the cooling zones. The gap should be small enough so that there is no loss in curling because curling is no longer starting at the point of maximum stress but also not too small otherwise tension in the hair may close the gap so that the heating zone contacts the cooling zone.

There is also the thermal zone 530 between the heating and cooling zones as described above. The thermal zone 530 may comprise two layers of pyrogel (or similar insulator). Each layer may be 2.5 mm thick. These layers may be attached to the opposed faces of the heaters to the surface contacting the hair. Significant heat is emitted from the rear (non contacting surface of the heater) and this needs to be controlled). Low emissivity coatings could also be used on the heaters to reduce heat transfer to the cooling zone. The inside edge 532 of the cooling zone navigates around the thermal zone. A second portion 540 of the cooling zone follows on from the first portion of the cooling zone. The first portion 536 has a radius of curvature of approximately 7 mm and the second portion 540 has a radius of curvature of approximately 12 mm. The cross-section 542 of the second portion is thus as generous as possible, in part to accommodate the heat pipe 502.

FIG. 17*c* shows the detail of the second arm. However, it will be appreciated that if the heating zone on the first arm contacts the cooling zone, heat will be transferred. This can be prevented by preventing yaw or other movement at the hinge (or other mechanism) which controls the relative movement of the two arms.

As explained above, the radius of curvature determines the nature of the curl and a preferred radius of curvature is 7 mm. As shown in FIG. 17*c*, the cooling zone preferably has this preferred radius for the first 90 degrees of the path over the cooling zone. Alternatively, the cooling zone may have a reduced radius immediately adjacent the heating zone, e.g. 3 mm, to reduce stress on the hair. Thereafter, the radius of curvature may be increased, e.g. to 12 mm, to increase the volume of the cooling zone. The curvature is continued though to provide a curved path length for as far as possible. For example, by rotating the apparatus, a skilled user could rotate the device to maintain the hair on the curved surface for longer. However, the increase in curvature is important because it increases the cross-section of the cooling zone to maximise heat transfer and to create an adequate thermal mass to minimise thermal spikes in the cooling zone in use. Moreover, the cross-section of the cooling zone is thus large enough to incorporate the heat pipe described above. The cooling zone is made from a conductive material to provide a thermal path from the hair to the heat sink to draw heat from the hair into the cooling zone and through to the heat pipe. Any suitable conductive material can be used, e.g. aluminium.

Figure 18B:
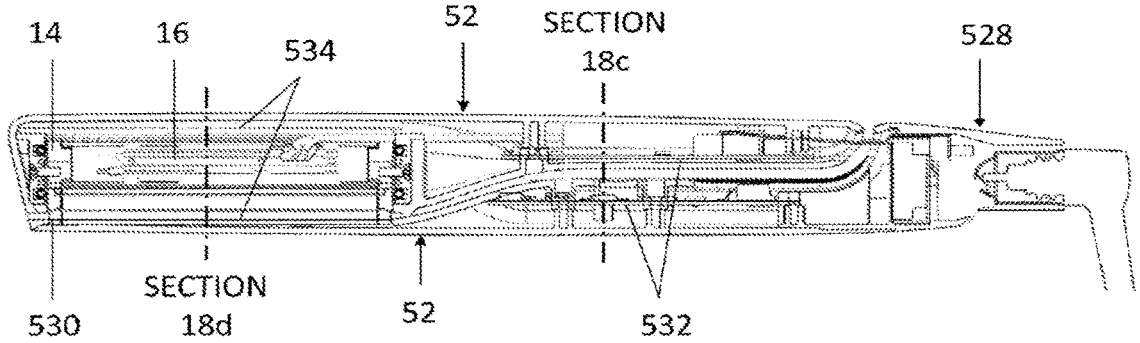
Figure 18C:
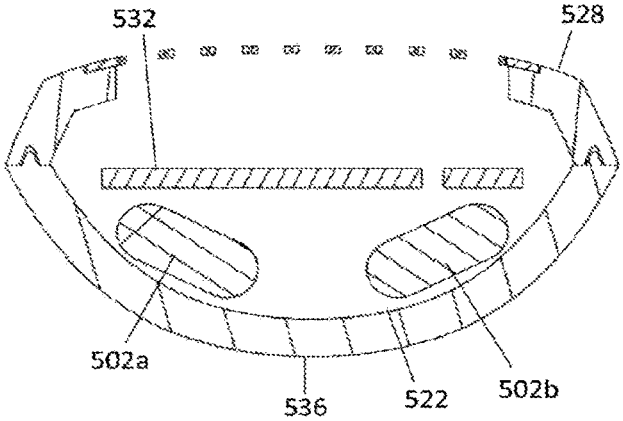
FIG. 18*c* is a cross-section along line AA of FIG. 18*a*.

FIGS. 18*a* and 18*b* show the full length of the apparatus both from the top and side with FIG. 18*c* showing a cross-section of the handle. The apparatus comprises a first arm having a heating zone 16 and a second arm having both a heating zone and cooling zones 14 either side of the heating zone 16. The two arms are joined together by a hinge at the opposed end to the heating and cooling zones to allow the arms to be brought into contact with each other in the heating and/or cooling zones. Handle portions for each arm extend between the hinge and the heating/cooling zones. A thermal zone 530 is positioned between the handle portion and the heating zones to prevent heat being transferred to the handle portion. Similarly, a thermal zone 530 is connected between the heating zone(s) and the end portion at the opposed end to the hinge.

The second arm (in this example the upper arm) has cooling zones 14 and thus the arm also has cooling along the length of the handle in the form of heat pipes 502*a*,502*b* drawing heat away from the cooling zones 14 to the heat sinks 528 at either end of the apparatus. One heat sink 528 is thus integrated into the hinge area of the handle and is thus an efficient use of materials. Control 532 for the heating elements is also integrated into the handle portion of each arm. The control 532 may be a PCB and may be designed to allow control of a heater having multiple heating zones and/or to allow for low voltage power. In this way, the handle portions provide function but are designed with a form (i.e. shape) which is comfortable and attractive for a user. If necessary, a plastic (or other insulating material) may be used to provide a cover 536 to increase the insulation on the handle to reduce the touch temperature. Similarly, the heating and cooling zones are mounted on plastics (or other insulating materials) support structure to reduce heating and ensure that the cover of the apparatus is not too hot to touch in the region of the heating and cooling zones.

In all the embodiments, direct contact between two plates is important to achieve efficient heat transfer to the hair. Achieving uniform heat up of the entire hair section is important for curl retention. The efficiency of the heat transfer created by two heater plates creates a flow of heat energy into the hair. By the addition of responsive temperature control of this surface, the temperature of hair within the apparatus may then be maintained with the movement of the plates along a hairs section. The movement along the apparatus creates friction and thus there may be a low friction coating on the surfaces of the heating zones and the cooling zones which are in contact with the hair.

By contrast, heating hair from a single surface (or side) is less efficient and relies on the heat transferring through the hair. However, hair is a good thermal insulator and this process takes time. One disadvantage is that such an apparatus cannot be simply moved along the hair. Furthermore, there is a temperature difference across the section of hair within the apparatus and this means that individual hairs within the section may curl different amounts or behave differently. This may create fly always and may additionally cause poor longevity of style. This is because that if the individual hairs are not behaving uniformly, the tighter curling fibres may end up supporting the weight of others and hence drop out more quickly.

Improved thermal control may be achieved by partitioning the heating zone up into a plurality of independently controllable smaller heating zones, each with their own heater element. Such individually controllable heating zones may be arranged along the length of the heater, such that each heating zone heats a different longitudinal section of the heater. This arrangement of heating zones enables the temperature can be controlled dependent on the thickness, quality, condition and/or distribution of hair.

In variants, the two heater plates may be formed as a single unit. Shaping of such a plate may be possible by either machining or casting them into such a shape, or alternatively shaping a piece of PEO coated metal (such as aluminium) as set out above.

To allow for ambidextrous apparatus operation, the embodiments illustrated are generally symmetrical, with cooling zones arranged either side of the heater zone. This makes styling easy on each side of the head and allows for left or right handed use. It some arrangements however this may not be essential and the cooling members may be placed on one side only to reduce both weight and cost of the apparatus. With cooling members present on only one side (i.e. to the left or right of the heating zone as viewed), the hair styling apparatus may be used in one direction to straighten hair, and in the other direction to curl hair or may be rotated between a curling orientation and a straightening orientation as described in relation to FIG. 2*a*.

No doubt many other effective alternatives will occur to the skilled person. It will be understood that the invention is not limited to the described embodiments and encompasses modifications apparent to those skilled in the art lying within the spirit and scope of the claims appended hereto.

Throughout the description and claims of this specification, the terms "styler" and "styling apparatus" are also used interchangeably. The words "comprise" and "contain" and variations of the words, for example "comprising" and "comprise", means "including but not limited to, and is not intended to (and does not) exclude other moieties, additives, components, integers or steps. Throughout the description and claims, the singular encompasses the plural unless the context otherwise requires. In particular, where the indefinite article is used, the specification is to be understood as contemplating plurality as well as singularity, unless the context requires otherwise.

Features, integers, characteristics or groups described in conjunction with a particular aspect, embodiment or example, of the invention are to be understood to be applicable to any other aspect, embodiment or example described herein unless incompatible therewith.

The invention claimed is:

1. A hair styling apparatus comprising a pair of closable jaws, the closable jaws comprising a first jaw and a second jaw;

wherein the closable jaws have complementary shapes, the first jaw defining a curved ridge including a first side and a second side coupled by a curved apex portion, and the second jaw defining a curved recess including a first side and a second side coupled by a curved base;

wherein the first and the second jaws are moveable from an open position, in which a first hair contacting surface of the first side of the curved ridge and a second hair contacting surface of the second side of the curved ridge, are spaced apart respectively from a first hair contacting surface of the first side of the curved recess and a second hair contacting surface of the second side of the curved recess, to a closed position in which the first hair contacting surface of the curved ridge is adjacent the first hair contacting surface of the curved recess and the second hair contacting surface of the curved ridge is adjacent the second hair contacting surface of the curved recess;

wherein the first side and the second side of one or both of the first jaw and the second jaw includes at least one heater such that, when the first jaw and the second jaws are moved to a closed position, hair is heated in a first heating region between the first side of the curved ridge of the first jaw and the first side of the curved recess of the second jaw, and in a second heating region between the second side of the curved ridge of the first jaw and the second side of the curved recess of the second jaw;

wherein the curved apex portion of the curved ridge and the curved base portion of the curved recess define an insulated region in which, when the first jaw and the second jaw are moved to the closed position, hair is not heated;

wherein the curved recess of first side of the second jaw has a first curved longitudinal surface including a first active cooling region on which hair is cooled and curved, and the second side of the second jaw has a second curved longitudinal surface including a second active cooling region on which hair is cooled and curved;

wherein a transverse cross section through the second jaw defines a forward curve defined by the curved recess of the second jaw, into which the curved ridge of the first jaw fits, the transverse cross section further defining a first reverse curve and a second reverse curve, wherein the forward curve links the first reverse curve and the second reverse curve, respectively, and wherein the first reverse curve includes the first active cooling region and the second reverse curve includes the second active cooling region;

wherein the first side of the first jaw includes a first curved flange that is curved in a shape complementary to the first active cooling region and the second side of said first jaw has a second curved flange that is curved in a shape complementary to the second active cooling region; and wherein the first curved flange extends across a portion of the first active cooling region and the second curved flange extends across a part but not all of the second active cooling region, so that, in use, the first and the second curved flanges guide a user's hair onto the first or the second active cooling regions when the hair styling apparatus is held by the user in a hair curling orientation, and allowing the user's hair to avoid the first or the second active cooling regions when the hair styling apparatus is held by the user in a hair straightening orientation.

2. The hair styling apparatus of claim 1, wherein the first or the second active cooling regions have a radius of curvature which increases from approximately 4 mm adjacent the first or the second heating regions to approximately 12 mm away from the first or the second heating regions.

3. The hair styling apparatus of claim 1, comprising:

a biasing mechanism for biasing the first and the second jaws in the open position;

at least one heat sink; and at least one heat pipe extending from the first active cooling region and the second active cooling region to the at least one heat sink, wherein the biasing mechanism is thermally connected to the at least one heat sink.

4. The hair styling apparatus of claim 3, comprising a fan assembly for cooling the first and the second active cooling regions, wherein the fan assembly is integrated within the at least one heat sink.

5. The hair styling apparatus of claim 4, further comprising an inlet through which air is drawn into the hair styling apparatus by the fan assembly, wherein the inlet is on an inner surface of at least one of the first and the second jaws and further comprising an outlet through which air forced out of the hair styling apparatus by the fan assembly, the outlet extending around an electrical connector through which the hair styling apparatus receives power.

6. The hair styling apparatus of claim 3, wherein the at least one heat sink comprises two heat sinks, the two heat sinks positioned at opposed ends of the hair styling apparatus, wherein the at least one heat pipe is connected to both heat sinks.

7. The hair styling apparatus of claim 1, comprising a biasing mechanism for biasing the first and the second jaws in the open position, wherein the biasing mechanism is in the form of a leaf spring.

8. The hair styling apparatus of claim 1, comprising at least one projection on an exposed surface of the curved ridge of the first jaw, the at least one projection maintaining a minimum spacing between the apex portion of the curved ridge of the first jaw and the curved recess of the second jaw when the first and the second jaws are in the closed position.

9. The hair styling apparatus of claim 1, further comprising at least one sensor providing sensor data and a processor which is configured to:

receive said sensor data;

process said sensor data to determine whether the hair styling apparatus is in an active state in which the hair styling apparatus is being used to style hair or in a passive state in which there is no styling;

determine whether or not the hair styling apparatus has changed between the active and passive states; and if the state has changed, control the at least one heater to change the temperature in the first and the second heating regions.

10. The hair styling apparatus of claim 9, wherein if the processor determines that the state has changed from the active state to the passive state, the processor is configured to reduce the temperature in the first and the second heating regions.

11. The hair styling apparatus of claim 9, wherein if the processor determines that the state has changed from the passive state to the active state, the processor is configured to increase the temperature in the in the first and the second heating regions.

12. The hair styling apparatus of claim 9, wherein the at least one sensor measures the temperature in the first or the second heating regions, and the processor is configured to determine that the apparatus is in the active state when the temperature reduces between subsequent measurements and/or wherein the at least one sensor measures the temperature in the first or the second active cooling regions, and the processor is configured to determine that the apparatus is in the active state when the temperature rises between subsequent measurements.

13. The hair styling apparatus of claim 9, wherein the at least one sensor measures power consumption within the first and the second heating regions and the processor is configured to determine that the apparatus is in the active state when the power consumption increases between subsequent measurements.

14. The hair styling apparatus of claim 1, further comprising:

at least one sensor providing sensor data; and a processor which is configured to:

receive said sensor data; and determine whether hair contacts the first heating region and the first active cooling region before the second heating region and the second active cooling region, or vice versa, as the hair styling apparatus is moved through the user's hair.

15. The hair styling apparatus of claim 14, wherein if the processor determines that the hair contacts the first heating region and the second active cooling region before the second heating region and the second active cooling region, the processor is configured to adjust power to the first heating region to be lower than the power to the second heating region.

16. The hair styling apparatus of claim 14, wherein the at least one sensor measures the temperature in the first and the second heating regions and the processor is configured to determine that the hair contacts the first heating region and the first active cooling region before the second heating region and the second active cooling region by determining that the temperature in the first heating region has decreased between subsequent measurements more than the temperature in the second heating region and/or wherein the at least one sensor measures the temperature in the first and the second active cooling regions and the processor is configured to determine that the hair contacts the first heating region and the first active cooling region for a longer period of time than before the second heating region and the second active cooling region by determining that the temperature in the first active cooling region has increased between subsequent measurements more than the temperature in the second active cooling region.

17. The hair styling apparatus of claim 1 further comprising at least one sensor providing sensor data and a processor which is configured to:

receive said sensor data;

determine whether or not the temperature in the first and the second active cooling regions are above a threshold temperature;

power down the hair styling apparatus when the determined temperature is above the threshold temperature; and regulate the power supply to the first and the second heating regions to regulate the temperature of the first and the second heating regions.

18. The hair styling apparatus of claim 1, wherein the hair styling apparatus includes a biasing mechanism, the biasing mechanism maintaining the first and the second heating regions in a parallel orientation relative to each other when the pair of closable jaws is in the open position or the closed position, wherein the biasing mechanism comprises four springs, one spring mounted adjacent each corner of the first and the second heating regions, and a corresponding recess for each spring wherein movement of each spring is controlled by constraining each spring within the corresponding recess.

19. The hair styling apparatus of claim 1, comprising at least one insulator between the first heating region and the first cooling region, and an insulator between the second active heating region and the second active cooling region.

20. The hair styling apparatus of claim 1, wherein a section of a surface of the first or the second side of the curved ridge which is adjacent the first or the second side of the curved recess when the closable pair of jaws are in the closed position is an insulated region.

* * * * *